US008866722B2

(12) United States Patent
Chuang et al.

(10) Patent No.: US 8,866,722 B2
(45) Date of Patent: Oct. 21, 2014

(54) DRIVING APPARATUS

(71) Applicant: Raydium Semiconductor Corporation, Hsinchu (TW)

(72) Inventors: Kai-Lan Chuang, Tainan (TW); Chien-Ru Chen, Ligang Township (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 133 days.

(21) Appl. No.: 13/740,055

(22) Filed: Jan. 11, 2013

(65) Prior Publication Data

US 2013/0181963 A1 Jul. 18, 2013

(30) Foreign Application Priority Data

Jan. 13, 2012 (TW) ..... 101101381 A

(51) Int. Cl.
*G09G 3/36* (2006.01)

(52) U.S. Cl.
CPC ..... *G09G 3/3611* (2013.01); *G09G 2310/0297* (2013.01); *G09G 3/3685* (2013.01); *G09G 3/3607* (2013.01)
USPC ..... 345/98

(58) Field of Classification Search
CPC ..... G09G 2310/0286; G09G 2310/0289
USPC ..... 345/98, 100
See application file for complete search history.

(56) References Cited

U.S. PATENT DOCUMENTS

| | | | | |
|---|---|---|---|---|
| 8,300,033 | B2 * | 10/2012 | Nam et al. | 345/204 |
| 8,446,600 | B2 * | 5/2013 | Misumi et al. | 358/1.13 |
| 2008/0001898 | A1 * | 1/2008 | Chang | 345/100 |
| 2012/0249608 | A1 * | 10/2012 | Ikari et al. | 345/690 |

* cited by examiner

*Primary Examiner* — Kevin M Nguyen

(57) ABSTRACT

A driving apparatus applied in a liquid crystal display are disclosed. Its first channel includes a first latching module, a first level-shifting module, a P-type digital/analog converting module, a first R2R module, and a P-type amplifying module, the second channel includes a second latching module, a second level-shifting module, a N-type digital/analog converting module, a second R2R module, and a N-type amplifying module. The P-type digital/analog converting module and N-type digital/analog converting module are selectively coupled to the first R2R module or the second R2R module. The first latching module receives a first digital signal and the first latching module outputs a first analog signal corresponding to the first digital signal. The second latching module receives a second digital signal and the second latching module outputs a second analog signal corresponding to the second digital signal.

8 Claims, 17 Drawing Sheets

DRIVING APPARATUS

BACKGROUND OF THE INVENTION

1. Field of the Invention

The invention relates to a liquid crystal display; in particular, to a driving apparatus applied in the liquid crystal display having a Zigzag panel.

2. Description of the Related Art

In recent years, with the development of display technology, various novel types of display apparatus having different functions and advantages are shown in the market. For example, the common liquid crystal display can use a Zigzag panel as its display panel.

Compared to an ordinary panel, the Zigzag panel will have one more data line, and a pad and two channels must be disposed in a source driver applied in a liquid crystal display having a Zigzag panel to meet the requirement of the Zigzag panel having one more data line. In addition, the conventional source driver applied in the liquid crystal display having the Zigzag panel cannot achieve the effect of offset cancel, so that the display quality of the liquid crystal display having the Zigzag panel fails to be improved.

SUMMARY OF THE INVENTION

Therefore, the invention provides a driving apparatus applied in a liquid crystal display to solve the above-mentioned problems occurred in the prior arts.

A first embodiment of the invention is a driving apparatus. In this embodiment, the driving apparatus includes 2N channels, and the 2N channels are divided into N channel groups, and N is a positive integer. Each channel group includes a first channel and a second channel adjacent to the first channel. The first channel includes at least one first latch module, a first level shift module, a P-type digital/analog conversion module, a first resistor ladder conversion module, and a P-type amplifying module. The second channel includes at least one second latch module, a second level shift module, an N-type digital/analog conversion module, a second resistor ladder conversion module, and an N-type amplifying module.

Wherein, the first level shift module of the first channel is coupled between the at least one first latch module and the P-type digital/analog conversion module, and the second level shift module of the second channel is coupled between the at least one second latch module and the N-type digital/analog conversion module; the P-type digital/analog conversion module of the first channel and the N-type digital/analog conversion module of the second channel are selectively coupled to the first resistor ladder conversion module of the first channel or the second resistor ladder conversion module of the second channel respectively. The P-type amplifying module and the N-type amplifying module are selectively coupled to the first resistor ladder conversion module of the first channel or the second resistor ladder conversion module of the second channel respectively. The at least one first latch module of the first channel receives a first digital signal and the first resistor ladder conversion module outputs a first analog signal corresponding to the first digital signal; the at least one second latch module of the second channel receives a second digital signal and the second resistor ladder conversion module outputs a second analog signal corresponding to the second digital signal.

In an embodiment, the liquid crystal display includes a ZigZag panel and the ZigZag panel includes 2N data lines.

In an embodiment, the driving apparatus further includes (2N+2) 2-to-1 multiplexers and (N+1) output multiplexers, wherein the P-type amplifying module of the first channel is coupled to a first 2-to-1 multiplexer and a third 2-to-1 multiplexer of the (2N+2) 2-to-1 multiplexers respectively, and the N-type amplifying module of the second channel is coupled to a second 2-to-1 multiplexer and a fourth 2-to-1 multiplexer of the (2N+2) 2-to-1 multiplexers respectively, the first 2-to-1 multiplexer and the third 2-to-1 multiplexer are coupled to an external signal respectively, a first output multiplexer of the (N+1) output multiplexers is coupled to the first 2-to-1 multiplexer, the second 2-to-1 multiplexer, and a first data line and a second data line of the 2N data lines of the ZigZag panel, a second output multiplexer is coupled to the third 2-to-1 multiplexer, the fourth 2-to-1 multiplexer, and a third data line and a fourth data line of the 2N data lines of the ZigZag panel, a (N+1)th output multiplexer is coupled to a (2N−1)th 2-to-1 multiplexer, a (2N)th 2-to-1 multiplexer, and a next first data line.

In an embodiment, the driving apparatus further includes N output multiplexers and (2N+1) 2-to-1 multiplexers, wherein the P-type amplifying module of the first channel and the N-type amplifying module of the second channel are both coupled to a first output multiplexer of the N output multiplexers, and a first 2-to-1 multiplexer of the (2N+1) 2-to-1 multiplexers is coupled to the first output multiplexer, the external signal, and the first data line, a second 2-to-1 multiplexer is coupled to the first output multiplexer and the second data line, a third 2-to-1 multiplexer is coupled to the first output multiplexer, the second output multiplexer, and the third data line, and the (2N+1) 2-to-1 multiplexer is coupled to the Nth output multiplexer and the next first data line.

In an embodiment, the driving apparatus further includes N 2-to-3 multiplexers, wherein the P-type amplifying module of the first channel and the N-type amplifying module of the second channel are both coupled to a first 2-to-3 multiplexer of the N 2-to-3 multiplexers, and the first 2-to-3 multiplexer is coupled to the first data line, the second data line, and the third data line, a second 2-to-3 multiplexer is coupled to the third data line, the fourth data line, and fifth data line, the Nth 2-to-3 multiplexer is coupled to the (2N−1)th data line, the (2N)th data line, and the next first data line.

Compared to the prior art, the driving apparatus of the invention is applied in the liquid crystal display having a Zigzag panel and can meet the requirement of the Zigzag panel without adding two additional channels. In this invention, the same column of sub-pixels of the Zigzag panel will receive input voltages from the same channel of the driving apparatus at different times to achieve the effect of cancelling offset to improve the display quality of the liquid crystal display.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
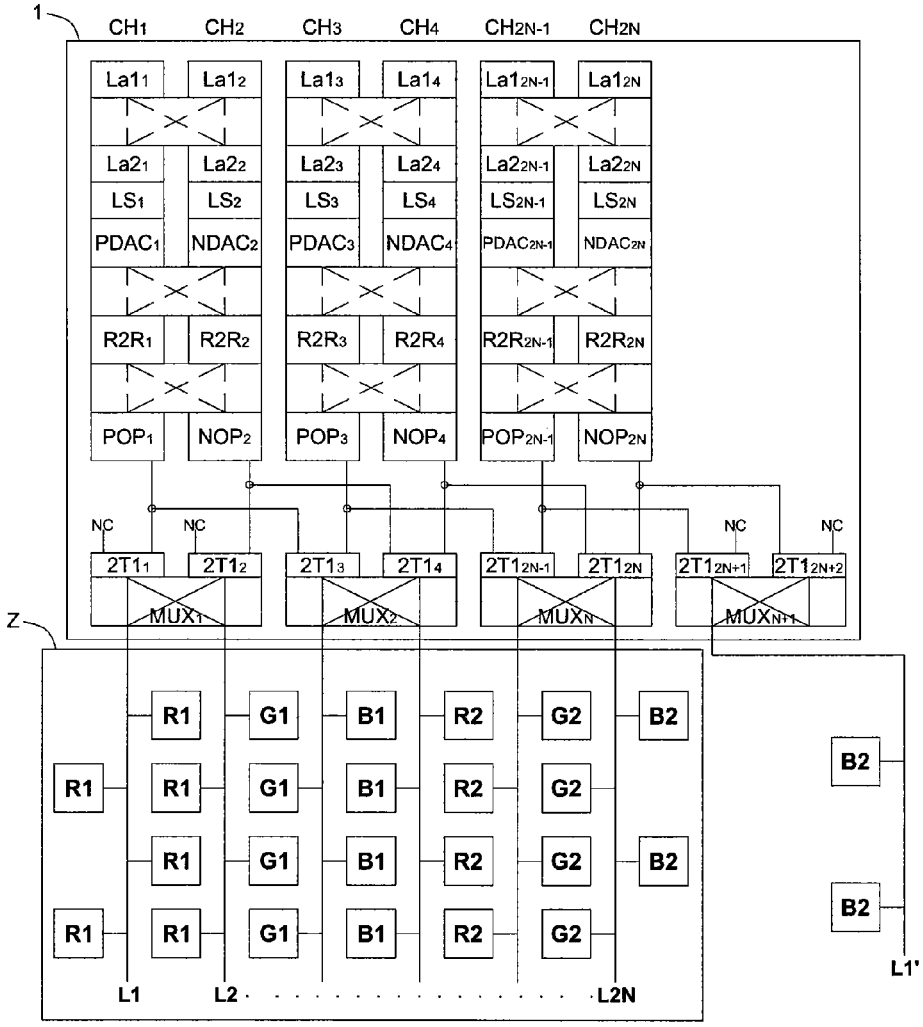
FIG. 1 illustrates a schematic diagram of the driving apparatus in the first embodiment of the invention.

A first embodiment of the invention is a driving apparatus. In this embodiment, the driving apparatus can be a source driver applied in a liquid crystal display, but not limited to this. The liquid crystal display can be a ZigZag panel. If the same column of sub-pixels of the Zigzag panel receives input voltages from the same channel of the driving apparatus at different times, the effect of cancelling offset can be achieved to improve the display quality of the liquid crystal display. Please refer to FIG. 1. FIG. 1 illustrates a schematic diagram of the driving apparatus in this embodiment.

As shown in FIG. 1, the driving apparatus 1 includes 2N channels $CH_1$~$CH_{2N}$, and the 2N channels $CH_1$~$CH_{2N}$ can be divided into N channel groups: $CH_1$ and $CH_2$, $CH_3$ and $CH_4$, . . . , $CH_{2N-1}$ and $CH_{2N}$. Taking the first channel group $CH_1$ and $CH_2$ for an example, the channel $CH_1$ includes a first latch module $La1_1$, a second latch module $La2_1$, a level shift module $LS_1$, a P-type digital/analog conversion module $PDAC_1$, a resistor ladder conversion module $R2R_1$, and a P-type amplifying module $POP_1$; the channel $CH_2$ includes a first latch module $La1_2$, a second latch module $La2_2$, a level shift module $LS_2$, a N-type digital/analog conversion module $NDAC_2$, a resistor ladder conversion module $R2R_2$, and a N-type amplifying module $NOP_2$.

Wherein, the first latch module $La1_1$ of the channel $CH_1$ is selectively coupled to the second latch module $La2_1$ of the channel $CH_1$ or the second latch module $La2_2$ of the channel $CH_2$; the first latch module $La1_2$ of the channel $CH_2$ is selectively coupled to the second latch module $La2_2$ of the channel $CH_2$ or the second latch module $La2_1$ of the channel $CH_1$; the level shift module $LS_1$ of the channel $CH_1$ is coupled between the second latch module $La2_1$ and the P-type digital/analog conversion module $PDAC_1$; the level shift module $LS_2$ of the channel $CH_2$ is coupled between the second latch module $La2_2$ and the N-type digital/analog conversion module $NDAC_2$; the P-type digital/analog conversion module $PDAC_1$ of the channel $CH_1$ is selectively coupled to the resistor ladder conversion module $R2R_1$ of the channel $CH_1$ or the resistor ladder conversion module $R2R_2$ of the channel $CH_2$; the N-type digital/analog conversion module $NDAC_2$ of the channel $CH_2$ is selectively coupled to the resistor ladder conversion module $R2R_2$ of the channel $CH_2$ or the resistor ladder conversion module $R2R_1$ of the channel $CH_1$; the resistor ladder conversion module $R2R_1$ of the channel $CH_1$ is selectively coupled to the P-type amplifying module $POP_1$ of the channel $CH_1$ or the N-type amplifying module $NOP_2$ of the channel $CH_2$; the resistor ladder conversion module $R2R_2$ of the channel $CH_2$ is selectively coupled to the N-type amplifying module $NOP_2$ of the channel $CH_2$ or the P-type amplifying module $POP_1$ of the channel $CH_1$.

It should be noted that in this embodiment, the driving apparatus 1 also includes (2N+2) 2-to-1 multiplexers $2T1_1$~$2T1_{2N+2}$ and (N+1) output multiplexers $MUX_1$~$MUX_{N+1}$. Wherein, each of the 2-to-1 multiplexers $2T1_1$~$2T1_{2N+2}$ has two input terminals and one output terminal; each of the (N+1) output multiplexers $MUX_1$~$MUX_{N+1}$ has two input terminals and two output terminals. Taking the 2-to-1 multiplexers $2T1_1$~$2T1_4$ for example, two input terminals of the 2-to-1 multiplexer $2T1_1$ are coupled to the P-type amplifying module $POP_1$ of the channel $CH_1$ and an external signal NC respectively; two input terminals of the 2-to-1 multiplexer $2T1_2$ are coupled to the N-type amplifying module $NOP_2$ of the channel $CH_2$ and the external signal NC respectively; two input terminals of the 2-to-1 multiplexer $2T1_3$ are coupled to a P-type amplifying module $POP_3$ of the channel $CH_3$ and the P-type amplifying module $POP_1$ of the channel $CH_1$ respectively; two input terminals of the 2-to-1 multiplexer $2T1_4$ are coupled to a N-type amplifying module $NOP_4$ of the channel $CH_4$ and the N-type amplifying module $NOP_2$ of the channel $CH_2$ respectively. Similarly, two input terminals of the 2-to-1 multiplexer $2T1_{2N+1}$ are coupled to the P-type amplifying module $POP_{2N-1}$ of the channel $CH_{2N-1}$ and the external signal NC respectively; two input terminals of the 2-to-1 multiplexer $2T1_{2N+2}$ are coupled to the N-type amplifying module $NOP_{2N}$ of the channel $CH_{2N}$ respectively.

Two input terminals of the output multiplexer $MUX_1$ are coupled to output terminals of the 2-to-1 multiplexers $2T1_1$ and $2T1_2$ respectively; two input terminals of the output multiplexer $MUX_2$ are coupled to output terminals of the 2-to-1 multiplexers $2T1_3$ and $2T1_4$ respectively; similarly, two input terminals of the output multiplexer $MUX_N$ are coupled to output terminals of the 2-to-1 multiplexers $2T1_{2N-1}$ and $2T1_{2N}$ respectively; two input terminals of the output multiplexer $MUX_{N+1}$ are coupled to output terminals of the 2-to-1 multiplexers $2T1_{2N+1}$ and $2T1_{2N+2}$ respectively.

The ZigZag panel Z includes 2N data lines L1~L2N. It should be noted that not all of each column of sub-pixels of the Zigzag panel Z is coupled to the same data line; instead, each column of sub-pixels of the Zigzag panel Z is coupled to two data lines at two sides in an interlacing way. Taking the first column of sub-pixels R1 of the Zigzag panel Z in FIG. 1 for example, the first sub-pixel and the third sub-pixel R1 are coupled to the first data line L1, while the second sub-pixel and the fourth sub-pixel R1 are coupled to the second data line L2. Similarly, the second column of sub-pixels G1 is in the same situation, the first sub-pixel and the third sub-pixel G1 are coupled to the second data line L2, while the second sub-pixel and the fourth sub-pixel G1 are coupled to the third data line L3, and so on.

Then, please refer to FIG. 2A through FIG. 2D. FIG. 2A, FIG. 2B, FIG. 2C, and FIG. 2D illustrate schematic diagrams of the signal transmission paths of the driving apparatus 1 in FIG. 1 under different operation modes respectively.

Figure 2A:
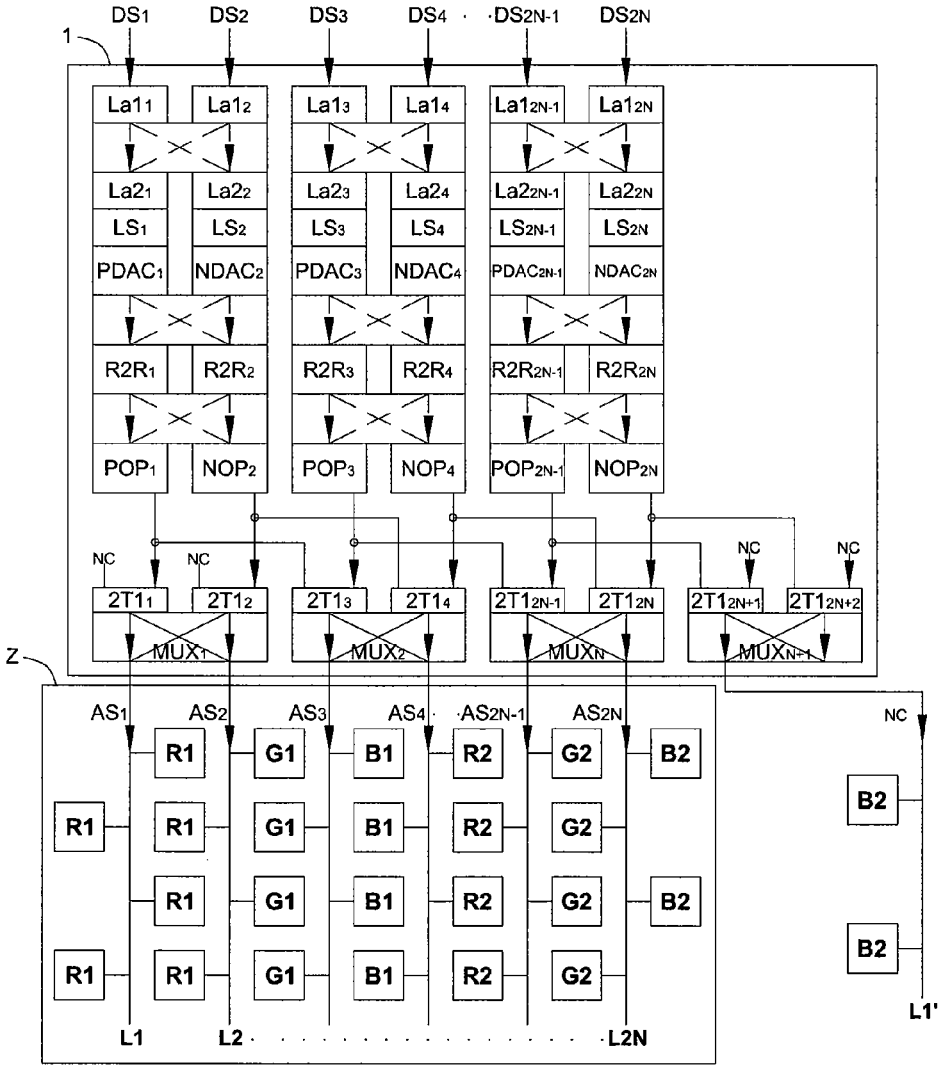
FIG. 2A, FIG. 2B, FIG. 2C, and FIG. 2D illustrate schematic diagrams of the signal transmission path of the driving apparatus 1 in FIG. 1 under different operation modes.

As shown in FIG. 2A, under the first operation mode of the driving apparatus 1, when the first latch module $La1_1$ of the channel $CH_1$ receives a first digital signal $DS_1$, the first latch module $La1_1$ transmits the first digital signal $DS_1$ to the second latch module $La2_1$ of the channel $CH_1$. Then, after the first digital signal $DS_1$ is processed by the level shift module $LS_1$, the P-type digital/analog conversion module $PDAC_1$, the resistor ladder conversion module $R2R_1$, and the P-type amplifying module $POP_1$ of the channel $CH_1$, the first digital signal $DS_1$ is converted into a first analog signal $AS_1$ and the first analog signal $AS_1$ is transmitted to the 2-to-1 multiplexer $2T1_1$, and then outputted to the first data line L1 of the ZigZag panel Z through the output multiplexer $MUX_1$.

When the first latch module $La1_2$ of the channel $CH_2$ receives a second digital signal $DS_2$, the first latch module $La1_2$ transmits the second digital signal $DS_2$ to the second latch module $La2_2$ of the channel $CH_2$. Then, after the second digital signal $DS_2$ is processed by the level shift module $LS_2$, the N-type digital/analog conversion module $NDAC_2$, the resistor ladder conversion module $R2R_2$, and the N-type amplifying module $NOP_2$ of the channel $CH_2$, the second digital signal $DS_2$ is converted into a second analog signal $AS_2$ and the second analog signal $AS_2$ is transmitted to the 2-to-1 multiplexers $2T1_2$, and then outputted to the second data line L2 of the ZigZag panel Z through the output multiplexer $MUX_1$.

Similarly, when the first latch module $La1_3$ of the channel $CH_3$ receives a third digital signal $DS_3$, the first latch module $La1_3$ transmits the third digital signal $DS_3$ to the second latch module $La2_3$ of the channel $CH_3$. Then, after the third digital signal $DS_3$ is processed by the level shift module $LS_3$, the P-type digital/analog conversion module $PDAC_3$, the resistor ladder conversion module $R2R_3$, and the P-type amplifying module $POP_3$ of the channel $CH_3$, the third digital signal $DS_3$ is converted into a third analog signal $AS_3$ and the third analog signal $AS_3$ is transmitted to the 2-to-1 multiplexers $2T1_3$, and then outputted to the third data line L3 of the ZigZag panel Z through the output multiplexer $MUX_2$. When the first latch module $La1_4$ of the channel $CH_4$ receives a fourth digital signal $DS_4$, the first latch module $La1_4$ transmits the fourth digital signal $DS_4$ to the second latch module $La2_4$ of the channel $CH_4$. Then, after the fourth digital signal $DS_4$ is processed by the level shift module $LS_4$, the N-type digital/analog conversion module $NDAC_4$, the resistor ladder conversion module $R2R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the 2-to-1 multiplexers $2T1_4$, and then outputted to the fourth data line L4 of the ZigZag panel Z through the output multiplexer $MUX_2$, and so on.

It should be noted that the first digital signal $DS_1$~the (2N)th digital signal $DS_{2N}$ inputted into the channels $CH_1$~$CH_{2N}$ respectively are processed by the driving apparatus 1 and then outputted to the first data line L1~the (2N)th data line L2N of the ZigZag panel Z through the 2-to-1 multiplexers $2T1_1$~$2T1_{2N}$ and the output multiplexers $MUX_1$~$MUX_N$ respectively. Therefore, the 2-to-1 multiplexers $2T1_{2N+1}$~$2T1_{2N+2}$ receive the external signal NC instead of the first digital signal $DS_1$~the (2N)th digital signal $DS_{2N}$, and the output multiplexer $MUX_{N+1}$ is coupled to the next first data line L1'.

Figure 2B:
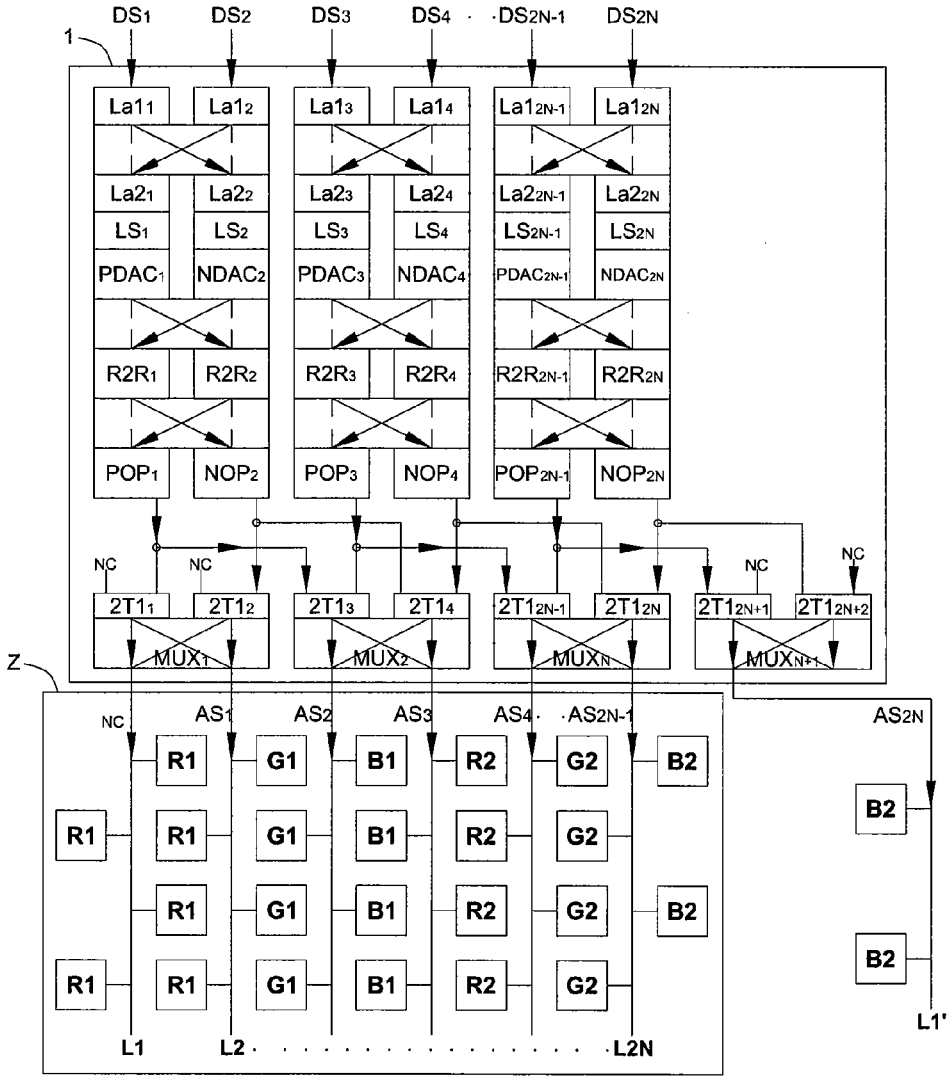

As shown in FIG. 2B, under the second operation mode of the driving apparatus 1, when the first latch module $La1_1$ of the channel $CH_1$ receives a first digital signal $DS_1$, the first latch module $La1_1$ transmits the first digital signal $DS_1$ to the second latch module $La2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module $R2R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the 2-to-1 multiplexers $2T1_2$, and then outputted to the second data line L2 of the ZigZag panel Z through the output multiplexer $MUX_1$.

When the first latch module $La1_2$ of the channel $CH_2$ receives a second digital signal $DS_2$, the first latch module $La1_2$ transmits the second digital signal $DS_2$ to the second latch module $La2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module $R2R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the 2-to-1 multiplexers $2T1_3$, and then outputted to the third data line L3 of the ZigZag panel Z through the output multiplexer $MUX_2$.

Similarly, when the first latch module $La1_3$ of the channel $CH_3$ receives a third digital signal $DS_3$, the first latch module $La1_3$ transmits the third digital signal $DS_3$ to the second latch module $La2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module $R2R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the 2-to-1 multiplexers $2T1_4$, and then outputted to the fourth data line L4 of the ZigZag panel Z through the output multiplexer $MUX_2$.

When the first latch module $La1_4$ of the channel $CH_4$ receives a fourth digital signal $DS_4$, the first latch module $La1_4$ transmits the fourth digital signal $DS_4$ to the second latch module $La2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module $R2R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the 2-to-1 multiplexers $2T1_5$, and then outputted to the fifth data line L5 of the ZigZag panel Z through the output multiplexer $MUX_3$, and so on.

It should be noted that the first digital signal $DS_1$~the (2N)th digital signal $DS_{2N}$ inputted into the channels CH1~CH2N respectively are processed by the driving apparatus 1 and then outputted to the second data line L2~the (2N)th data line L2N and the next first data line L1' of the ZigZag panel Z through the 2-to-1 multiplexers $2T1_2$~$2T1_{2N+1}$ and the output multiplexers $MUX_1$~$MUX_N$ respectively. Therefore, the 2-to-1 multiplexers $2T1_1$ and $2T1_{2N+2}$ receive the external signal NC instead of the first digital signal $DS_1$~the (2N)th digital signal $DS_{2N}$, and the output multiplexer $MUX_{N+1}$ is coupled to the next first data line L1', so that the external signal NC received by the 2-to-1 multiplexer $2T1_{2N+1}$ can be outputted to the next first data line L1' through the output multiplexer $MUX_{N+1}$. The external signal NC received by the 2-to-1 multiplexer $2T1_1$ is outputted to the first data line L1 of the ZigZag panel Z through the output multiplexer $MUX_1$.

After comparing FIG. 2A with FIG. 2B, it can be found that the first analog signal $AS_1$~the (2N)th analog signal $AS_{2N}$ outputted by the driving apparatus 1 in FIG. 2A under the first operation mode are transmitted to the first data line L1~the (2N)th data line L2N of the ZigZag panel Z respectively; the first analog signal $AS_1$~the (2N)th analog signal $AS_{2N}$ outputted by the driving apparatus 1 in FIG. 2B under the second operation mode are transmitted to the second data line L2~the (2N)th data line L2N and the next first data line L1' of the ZigZag panel Z respectively.

Figure 2C:
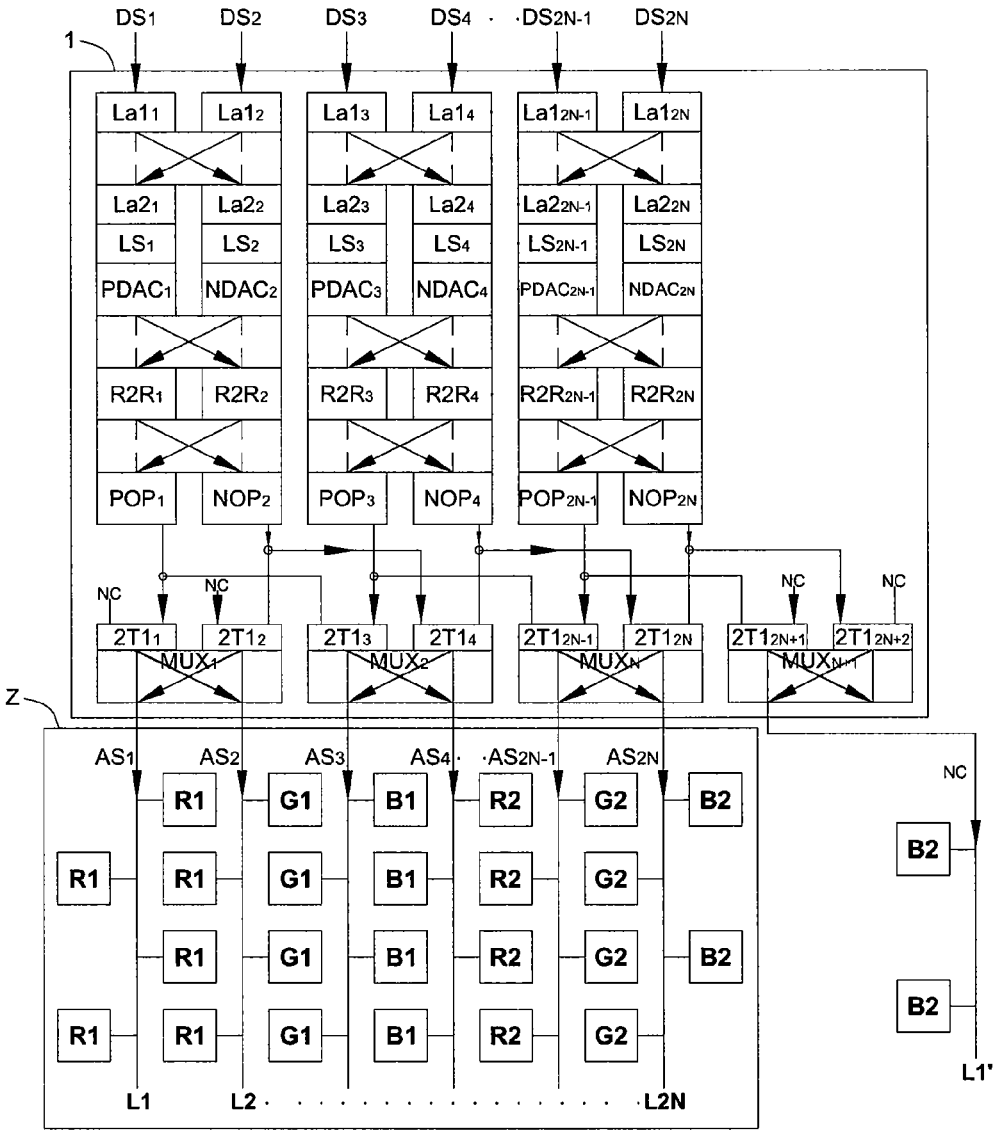

As shown in FIG. 2C, under the third operation mode of the driving apparatus 1, when the first latch module $La1_1$ of the channel $CH_1$ receives the first digital signal $DS_1$, the first latch module La$1_1$ transmits the first digital signal $DS_1$ to the second latch module La$2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module R2$R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the 2-to-1 multiplexer 2T$1_2$, and then outputted to the first data line L1 of the ZigZag panel Z through the output multiplexer $MUX_1$.

When the first latch module La$1_2$ of the channel $CH_2$ receives the second digital signal $DS_2$, the first latch module La$1_2$ transmits the second digital signal $DS_2$ to the second latch module La$2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module R2$R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the 2-to-1 multiplexers 2T$1_1$, and then outputted to the second data line L2 of the ZigZag panel Z through the output multiplexer $MUX_1$.

Similarly, when the first latch module La$1_3$ of the channel $CH_3$ receives the third digital signal $DS_3$, the first latch module La$1_3$ transmits the third digital signal $DS_3$ to the second latch module La$2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module R2$R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the 2-to-1 multiplexers 2T$1_4$, and then outputted to the third data line L3 of the ZigZag panel Z through the output multiplexer $MUX_2$.

When the first latch module La$1_4$ of the channel $CH_4$ receives the fourth digital signal $DS_4$, the first latch module La$1_4$ transmits the fourth digital signal $DS_4$ to the second latch module La$2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module R2$R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the 2-to-1 multiplexers 2T$1_3$, and then outputted to the fourth data line L4 of the ZigZag panel Z through the output multiplexer $MUX_2$, and so on.

It should be noted that the first digital signal $DS_1$~the (2N)th digital signal $DS_{2N}$ inputted into the channels $CH_1$~$CH_{2N}$ respectively are processed by the driving apparatus 1 and then outputted to the first data line L1~the (2N)th data line L2N of the ZigZag panel Z through the 2-to-1 multiplexers 2T$1_1$~2T$1_{2N}$ and the output multiplexers $MUX_1$~$MUX_N$ respectively. Therefore, the 2-to-1 multiplexers 2T$1_{2N+1}$~2T$1_{2N+2}$ receive the external signal NC instead of the first digital signal $DS_1$~the (2N)th digital signal $DS_{2N}$, and the output multiplexer $MUX_{N+1}$ is coupled to the next first data line L1', so that the external signal NC received by the 2-to-1 multiplexer 2T$1_{2N+2}$ can be outputted to the next first data line L1' through the output multiplexer $MUX_{N+1}$.

Figure 2D:
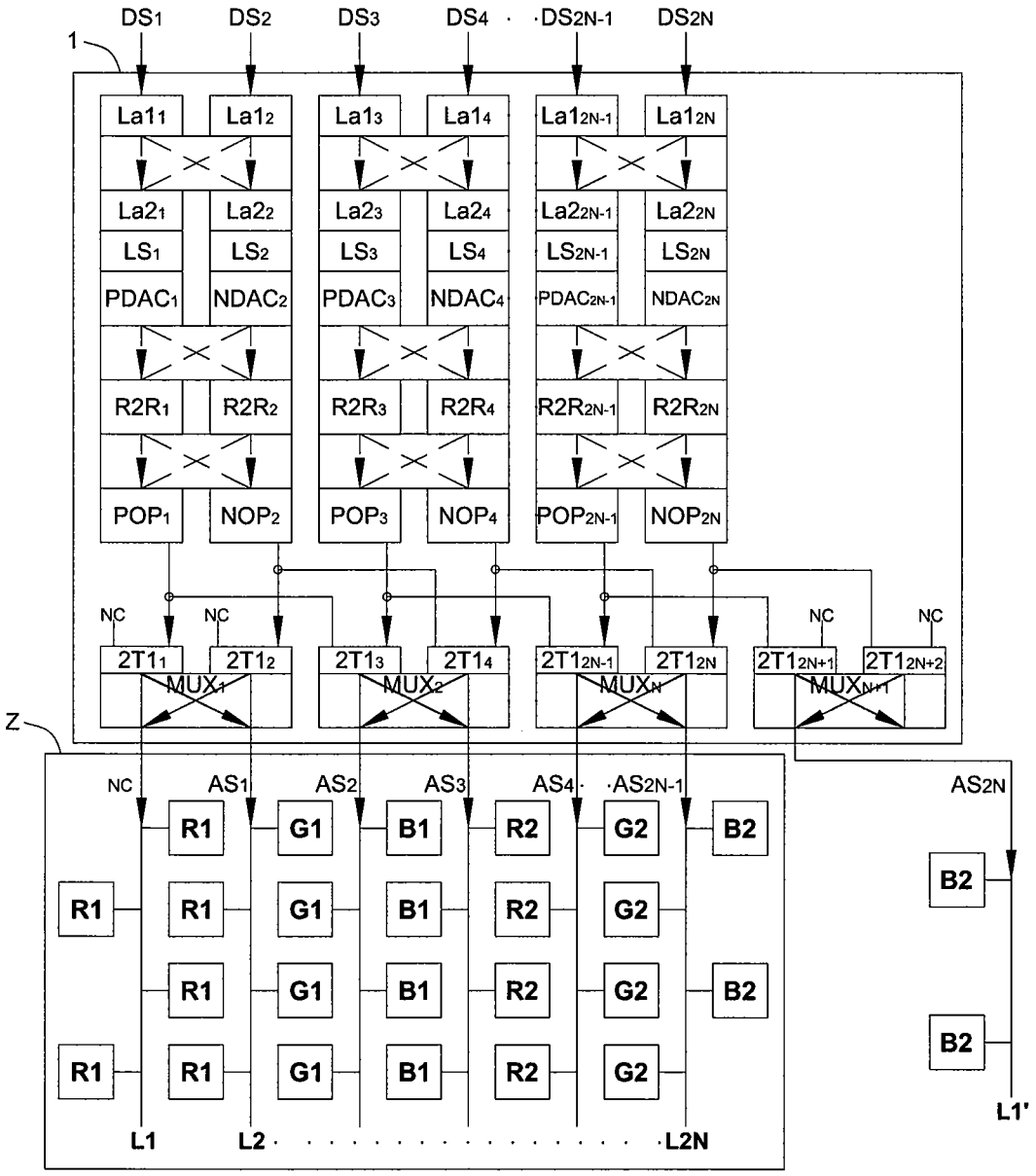

As shown in FIG. 2D, under the fourth operation mode of the driving apparatus 1, when the first latch module La$1_1$ of the channel $CH_1$ receives the first digital signal $DS_1$, the first latch module La$1_1$ transmits the first digital signal $DS_1$ to the second latch module La$2_1$ of the channel $CH_1$. Then, after the first digital signal $DS_1$ is processed by the level shift module $LS_1$, the P-type digital/analog conversion module $PDAC_1$, the resistor ladder conversion module R2$R_1$, and the P-type amplifying module $POP_1$ of the channel $CH_1$, the first digital signal $DS_1$ is converted into a first analog signal $AS_1$ and the first analog signal $AS_1$ is transmitted to the 2-to-1 multiplexers 2T$1_1$, and then outputted to the second data line L2 of the ZigZag panel Z through the output multiplexer $MUX_1$.

When the first latch module La$1_2$ of the channel $CH_2$ receives the second digital signal $DS_2$, the first latch module La$1_2$ transmits the second digital signal $DS_2$ to the second latch module La$2_2$ of the channel $CH_2$. Then, after the second digital signal $DS_2$ is processed by the level shift module $LS_2$, the N-type digital/analog conversion module $NDAC_2$, the resistor ladder conversion module R2$R_2$, and the N-type amplifying module $NOP_2$ of the channel $CH_2$, the second digital signal $DS_2$ is converted into a second analog signal $AS_2$ and the second analog signal $AS_2$ is transmitted to the 2-to-1 multiplexers 2T$1_4$, and then outputted to the third data line L3 of the ZigZag panel Z through the output multiplexer $MUX_2$.

Similarly, when the first latch module La$1_3$ of the channel $CH_3$ receives a third digital signal $DS_3$, the first latch module La$1_3$ transmits the third digital signal $DS_3$ to the second latch module La$2_3$ of the channel $CH_3$. Then, after the third digital signal $DS_3$ is processed by the level shift module $LS_3$, the P-type digital/analog conversion module $PDAC_3$, the resistor ladder conversion module R2$R_3$, and the P-type amplifying module $POP_3$ of the channel $CH_3$, the third digital signal $DS_3$ is converted into a third analog signal $AS_3$ and the third analog signal $AS_3$ is transmitted to the 2-to-1 multiplexers 2T$1_3$, and then outputted to the fourth data line L4 of the ZigZag panel Z through the output multiplexer $MUX_2$. When the first latch module La$1_4$ of the channel $CH_4$ receives a fourth digital signal $DS_4$, the first latch module La$1_4$ transmits the fourth digital signal $DS_4$ to the second latch module La$2_4$ of the channel $CH_4$. Then, after the fourth digital signal $DS_4$ is processed by the level shift module $LS_4$, the N-type digital/analog conversion module $NDAC_4$, the resistor ladder conversion module R2$R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the 2-to-1 multiplexers 2T$1_6$, and then outputted to the fifth data line L5 of the ZigZag panel Z through the output multiplexer $MUX_3$, and so on.

It should be noted that the first digital signal $DS_1$~the (2N)th digital signal $DS_{2N}$ inputted into the channels $CH_1$~$CH_{2N}$ respectively are processed by the driving apparatus 1 and then outputted to the first data line L1~the (2N)th data line L2N and the next first data line T1' of the ZigZag panel Z through the 2-to-1 multiplexers 2T$1_1$ and 2T$1_3$~2T$1_{2N+2}$ and the output multiplexers $MUX_1$~$MUX_N$ respectively. Therefore, the 2-to-1 multiplexers 2T$1_2$ and 2T$1_{2N+1}$ receive the external signal NC instead of the first digital signal $DS_1$~the (2N)th digital signal $DS_{2N}$, and the output multiplexer $MUX_{N+1}$ is coupled to the next first data line L1', so that the (2N)th analog signal $AS_{2N}$ received by the 2-to-1 multiplexer 2T$1_{2N+2}$ can be outputted to the next first data line L1' through the output multiplexer $MUX_{N+1}$. The external signal NC received by the 2-to-1 multiplexer 2T$1_2$ is outputted to the first data line L1 of the ZigZag panel Z through the output multiplexer $MUX_1$.

After comparing FIG. 2C with FIG. 2D, it can be found that the first analog signal $AS_1$~the (2N)th analog signal $AS_{2N}$ outputted by the driving apparatus 1 in FIG. 2C under the third operation mode are transmitted to the first data line L1~the (2N)th data line L2N of the ZigZag panel Z respectively; the first analog signal $AS_1$~the (2N)th analog signal $AS_{2N}$ outputted by the driving apparatus 1 in FIG. 2D under the fourth operation mode are transmitted to the second data line L2~the (2N)th data line L2N and the next first data line L1' of the ZigZag panel Z respectively.

Figure 3:
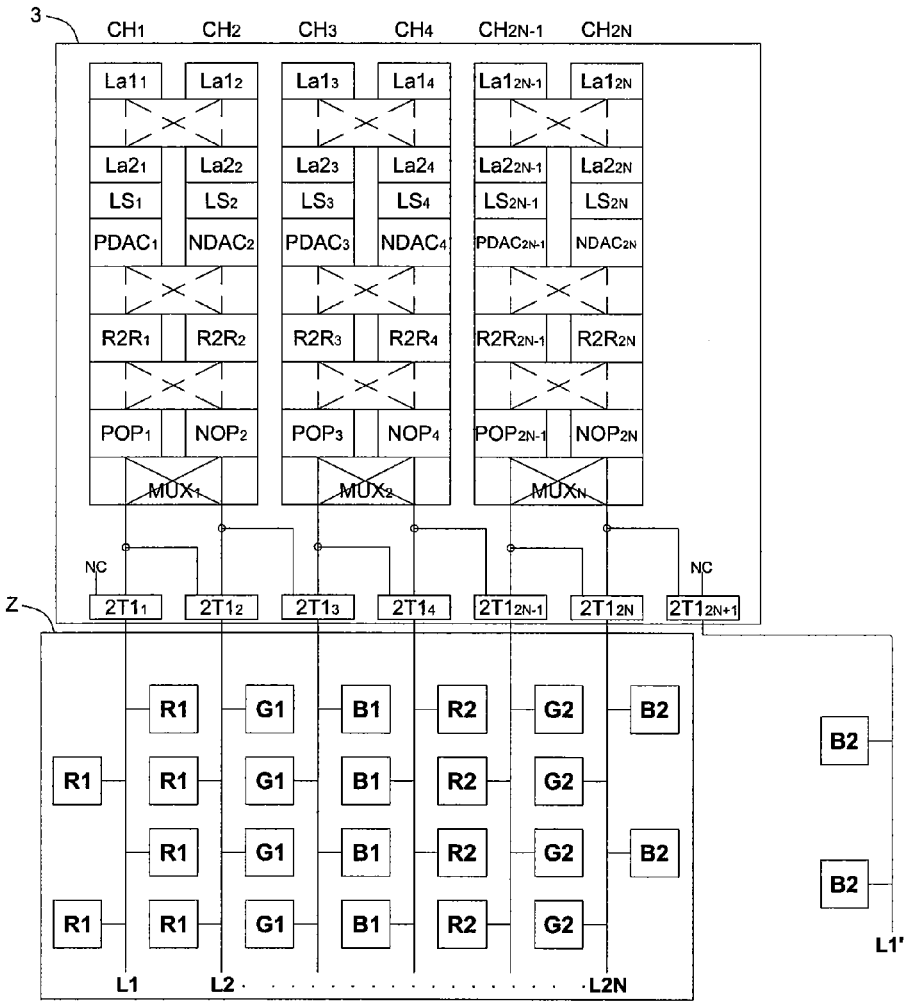
FIG. 3 illustrates a schematic diagram of the driving apparatus in the second embodiment of the invention.

A second embodiment of the invention is a driving apparatus. In this embodiment, the driving apparatus can be a source driver applied in a liquid crystal display, but not limited to this. The liquid crystal display can be a ZigZag panel. If the same column of sub-pixels of the Zigzag panel receives input voltages from the same channel of the driving apparatus at different times, the effect of cancelling offset can be achieved to improve the display quality of the liquid crystal display. Please refer to FIG. 3. FIG. 3 illustrates a schematic diagram of the driving apparatus in this embodiment. As shown in FIG. 3, the driving apparatus 3 includes 2N channels $CH_1$~$CH_{2N}$, and the 2N channels $CH_1$~$CH_{2N}$ can be divided into N channel groups: $CH_1$ and $CH_2$, $CH_3$ and $CH_4$, . . . , $CH_{2N-1}$ and $CH_{2N}$. Taking the first channel group $CH_1$ and $CH_2$ for example, the channel $CH_1$ includes a first latch module $La1_1$, a second latch module $La2_1$, a level shift module $LS_1$, a P-type digital/analog conversion module $PDAC_1$, a resistor ladder conversion module $R2R_1$, and a P-type amplifying module $POP_1$; the channel $CH_2$ includes a first latch module $La1_2$, a second latch module $La2_2$, a level shift module $LS_2$, a N-type digital/analog conversion module $NDAC_2$, a resistor ladder conversion module $R2R_2$, and a N-type amplifying module $NOP_2$.

Wherein, the first latch module $La1_1$ of the channel $CH_1$ is selectively coupled to the second latch module $La2_1$ of the channel $CH_1$ or the second latch module $La2_2$ of the channel $CH_2$; the first latch module $La1_2$ of the channel $CH_2$ is selectively coupled to the second latch module $La2_2$ of the channel $CH_2$ or the second latch module $La2_1$ of the channel $CH_1$; the level shift module $LS_1$ of the channel $CH_1$ is coupled between the second latch module $La2_1$ and the P-type digital/analog conversion module $PDAC_1$; the level shift module $LS_2$ of the channel $CH_2$ is coupled between the second latch module $La2_2$ and the N-type digital/analog conversion module $NDAC_2$; the P-type digital/analog conversion module $PDAC_1$ of the channel $CH_1$ is selectively coupled to the resistor ladder conversion module $R2R_1$ of the channel $CH_1$ or the resistor ladder conversion module $R2R_2$ of the channel $CH_2$; the N-type digital/analog conversion module $NDAC_2$ of the channel $CH_2$ is selectively coupled to the resistor ladder conversion module $R2R_2$ of the channel $CH_2$ or the resistor ladder conversion module $R2R_1$ of the channel $CH_1$; the resistor ladder conversion module $R2R_1$ of the channel $CH_1$ is selectively coupled to the P-type amplifying module $POP_1$ of the channel $CH_1$ or the N-type amplifying module $NOP_2$ of the channel $CH_2$; the resistor ladder conversion module $R2R_2$ of the channel $CH_2$ is selectively coupled to the N-type amplifying module $NOP_2$ of the channel $CH_2$ or the P-type amplifying module $POP_1$ of the channel $CH_1$.

It should be noted that in this embodiment, the driving apparatus 3 also includes N output multiplexers $MUX_1$~$MUX_N$ and (2N+1) 2-to-1 multiplexers $2T1_1$~$2T1_{2N+1}$, each of the 2-to-1 multiplexers $2T1_1$~$2T1_{2N+1}$ has two input terminals and one output terminal; each of the N output multiplexers $MUX_1$~$MUX_N$ has two input terminals and two output terminals. Taking the output multiplexers $MUX_1$~$MUX_4$ for example, two input terminals of the output multiplexers $MUX_1$ are coupled to the P-type amplifying module $POP_1$ of the channel $CH_1$ and the N-type amplifying module $NOP_2$ of the channel $CH_2$, and so on. Taking the 2-to-1 multiplexers $2T1_1$~$2T1_4$ for example, two input terminals of the 2-to-1 multiplexer $2T1_1$ are coupled to the P-type amplifying module $POP_1$ of the channel $CH_1$ and the external signal NC respectively; two input terminals of the 2-to-1 multiplexer $2T1_2$ are coupled to the N-type amplifying module $NOP_2$ of the channel $CH_2$ and the P-type amplifying module $POP_1$ of the channel $CH_1$ respectively; two input terminals of the 2-to-1 multiplexer $2T1_3$ are coupled to a P-type amplifying module $POP_3$ of the channel $CH_3$ and the N-type amplifying module $NOP_2$ of the channel $CH_2$ respectively; two input terminals of the 2-to-1 multiplexer $2T1_4$ are coupled to a N-type amplifying module $NOP_4$ of the channel $CH_4$ and the P-type amplifying module $POP_3$ of the channel $CH_3$ respectively. Similarly, two input terminals of the 2-to-1 multiplexer $2T1_{2N+1}$ are coupled to the N-type amplifying module $NOP_{2N}$ of the channel $CH_{2N}$ and the external signal NC respectively; the output terminals of the 2-to-1 multiplexers $2T1_1$~$2T1_{2N+1}$ are coupled to the touch pad $PAD_1$~$PAD_{N+1}$ respectively.

Then, please refer to FIG. 4A through FIG. 4D. FIG. 4A, FIG. 4B, FIG. 4C, and FIG. 4D illustrate schematic diagrams of the signal transmission paths of the driving apparatus 3 in FIG. 3 under different operation modes respectively.

Figure 4A:
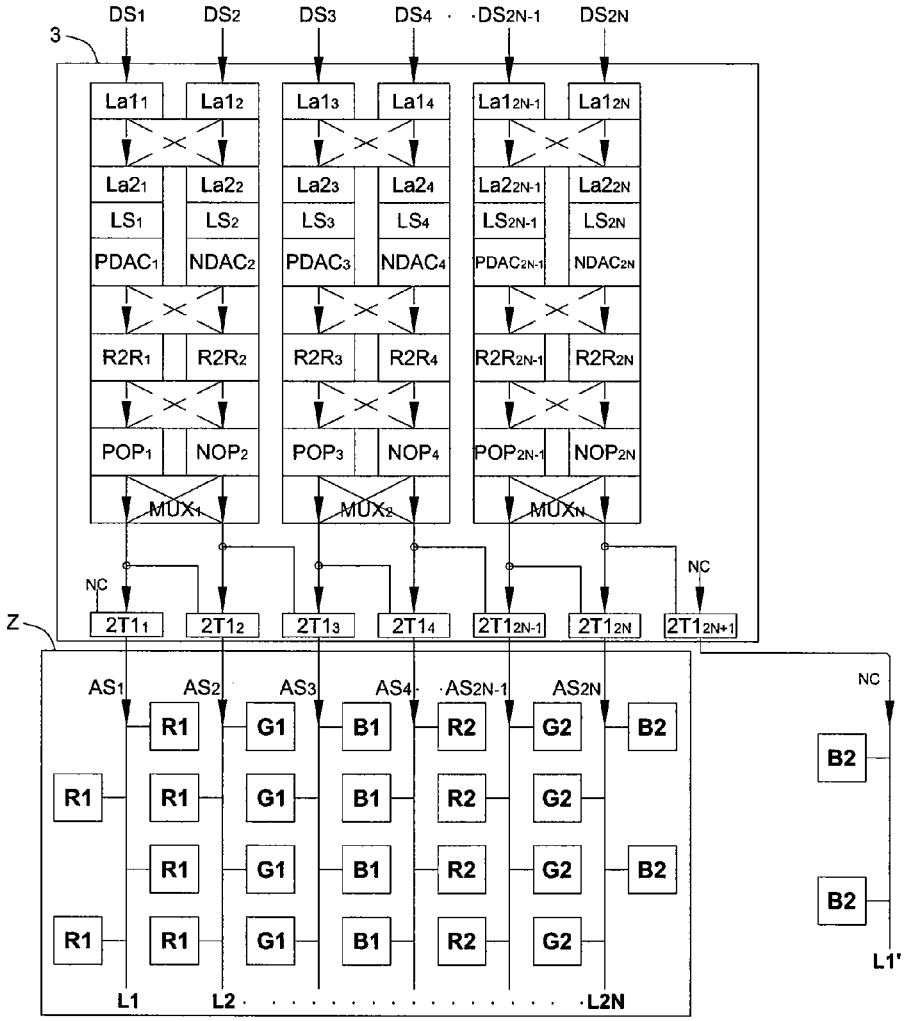
FIG. 4A, FIG. 4B, FIG. 4C, and FIG. 4D illustrate schematic diagrams of the signal transmission path of the driving apparatus 3 in FIG. 3 under different operation modes.

As shown in FIG. 4A, under the first operation mode of the driving apparatus 3, when the first latch module $La1_1$ of the channel $CH_1$ receives a first digital signal $DS_1$, the first latch module $La1_1$ transmits the first digital signal $DS_1$ to the second latch module $La2_1$ of the channel $CH_1$. Then, after the first digital signal $DS_1$ is processed by the level shift module $LS_1$, the P-type digital/analog conversion module $PDAC_1$, the resistor ladder conversion module $R2R_1$, and the P-type amplifying module $POP_1$ of the channel $CH_1$, the first digital signal $DS_1$ is converted into a first analog signal $AS_1$ and the first analog signal $AS_1$ is transmitted to the output multiplexer $MUX_1$, and then outputted to the first data line L1 of the ZigZag panel Z through the 2-to-1 multiplexer $2T1_1$.

When the first latch module $La1_2$ of the channel $CH_2$ receives a second digital signal $DS_2$, the first latch module $La1_2$ transmits the second digital signal $DS_2$ to the second latch module $La2_2$ of the channel $CH_2$. Then, after the second digital signal $DS_2$ is processed by the level shift module $LS_2$, the N-type digital/analog conversion module $NDAC_2$, the resistor ladder conversion module $R2R_2$, and the N-type amplifying module $NOP_2$ of the channel $CH_2$, the second digital signal $DS_2$ is converted into a second analog signal $AS_2$ and the second analog signal $AS_2$ is transmitted to the output multiplexer $MUX_1$, and then outputted to the second data line L2 of the ZigZag panel Z through the 2-to-1 multiplexers $2T1_2$.

Similarly, when the first latch module $La1_3$ of the channel $CH_3$ receives a third digital signal $DS_3$, the first latch module $La1_3$ transmits the third digital signal $DS_3$ to the second latch module $La2_3$ of the channel $CH_3$. Then, after the third digital signal $DS_3$ is processed by the level shift module $LS_3$, the P-type digital/analog conversion module $PDAC_3$, the resistor ladder conversion module $R2R_3$, and the P-type amplifying module $POP_3$ of the channel $CH_3$, the third digital signal $DS_3$ is converted into a third analog signal $AS_3$ and the third analog signal $AS_3$ is transmitted to the output multiplexer $MUX_2$, and then outputted to the third data line L3 of the ZigZag panel Z through the 2-to-1 multiplexers $2T1_3$. When the first latch module $La1_4$ of the channel $CH_4$ receives a fourth digital signal $DS_4$, the first latch module $La1_4$ transmits the fourth digital signal $DS_4$ to the second latch module $La2_4$ of the channel $CH_4$. Then, after the fourth digital signal $DS_4$ is processed by the level shift module $LS_4$, the N-type digital/analog conversion module $NDAC_4$, the resistor ladder conversion module $R2R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the output multiplexer $MUX_2$, and then outputted to the fourth data line L4 of the ZigZag panel Z through the 2-to-1 multiplexers $2T1_4$, and so on.

It should be noted that the first digital signal $DS_1$~the (2N)th digital signal $DS_{2N}$ inputted into the channels $CH_1$~$CH_{2N}$ respectively are processed by the driving apparatus 3 and then outputted to the first data line L1~the (2N)th data line L2N of the ZigZag panel Z through the output multiplexers $MUX_1$~$MUX_N$ and the 2-to-1 multiplexers $2T1_1$~$2T1_{2N}$ respectively. Therefore, the 2-to-1 multiplexer $2T1_{2N+1}$ receives the external signal NC instead of the first digital signal $DS_1$~the (2N)th digital signal $DS_{2N}$, and the 2-to-1 multiplexer $2T1_{2N+1}$ is coupled to the next first data line L1', and the external signal NC received by the 2-to-1 multiplexer $2T1_{2N+1}$ can be transmitted to the next first data line L1'.

Figure 4B:
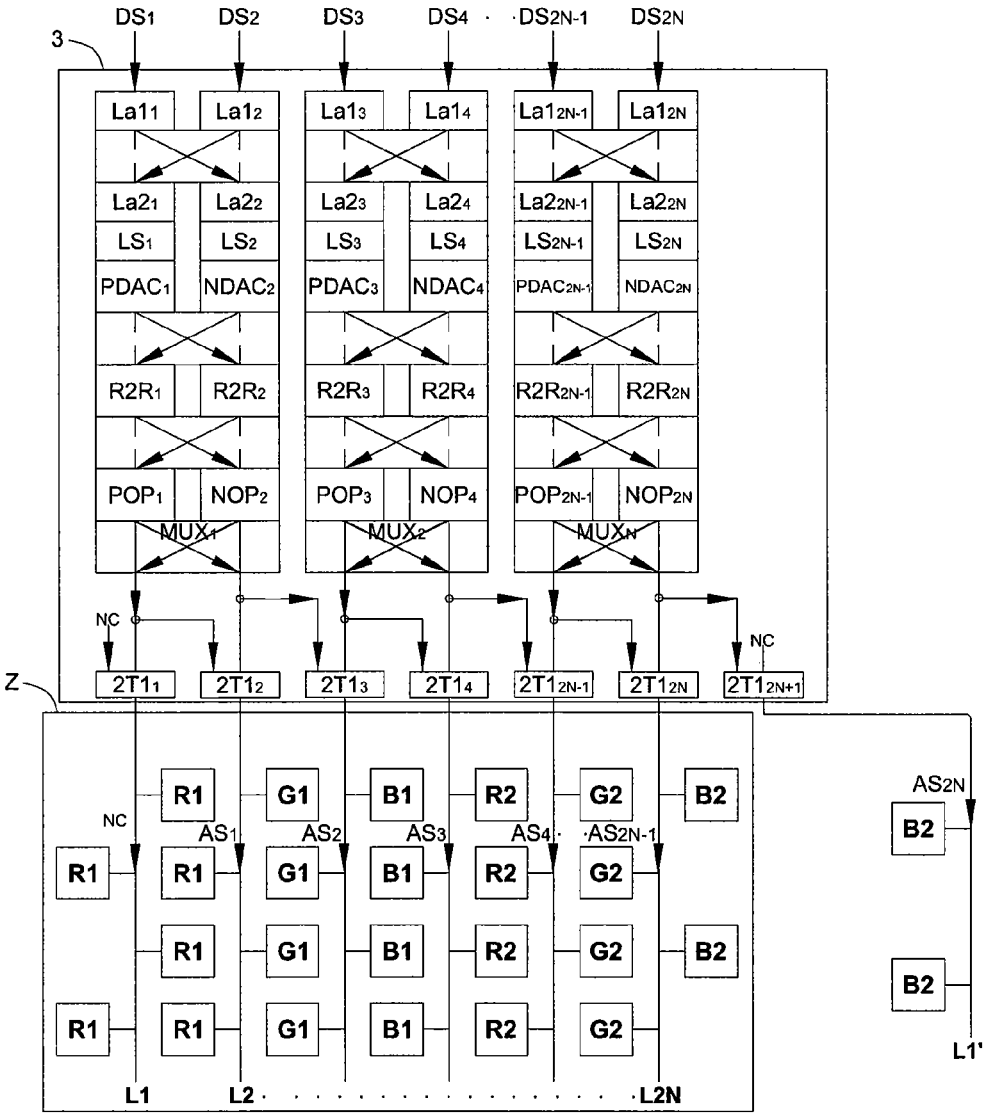

As shown in FIG. 4B, under the second operation mode of the driving apparatus 3, when the first latch module $La1_1$ of the channel $CH_1$ receives the first digital signal $DS_1$, the first latch module $La1_1$ transmits the first digital signal $DS_1$ to the second latch module $La2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module $R2R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the output multiplexer $MUX_1$, and then outputted to the second data line L2 of the ZigZag panel Z through the 2-to-1 multiplexers $2T1_2$.

When the first latch module $La1_2$ of the channel $CH_2$ receives the second digital signal $DS_2$, the first latch module $La1_2$ transmits the second digital signal $DS_2$ to the second latch module $La2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module $R2R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the output multiplexer $MUX_1$, and then outputted to the third data line L3 of the ZigZag panel Z through the 2-to-1 multiplexers $2T1_3$.

Similarly, when the first latch module $La1_3$ of the channel $CH_3$ receives the third digital signal $DS_3$, the first latch module $La1_3$ transmits the third digital signal $DS_3$ to the second latch module $La2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module $R2R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the output multiplexer $MUX_2$, and then outputted to the fourth data line L4 of the ZigZag panel Z through the 2-to-1 multiplexers $2T1_4$.

When the first latch module $La1_4$ of the channel $CH_4$ receives a fourth digital signal $DS_4$, the first latch module $La1_4$ transmits the fourth digital signal $DS_4$ to the second latch module $La2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module $R2R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the output multiplexer $MUX_2$, and then outputted to the fifth data line L5 of the ZigZag panel Z through the 2-to-1 multiplexers $2T1_5$, and so on.

It should be noted that the first digital signal $DS_1$~the (2N)th digital signal $DS_{2N}$ inputted into the channels $CH_1$~$CH_{2N}$ respectively are processed by the driving apparatus 3 and then outputted to the second data line L2~the (2N)th data line L2N and the next first data line L1' of the ZigZag panel Z through the output multiplexers $MUX_1$~$MUX_N$ and the 2-to-1 multiplexers $2T1_{2N+1}$ respectively. Therefore, the 2-to-1 multiplexers $2T1_1$ receives the external signal NC instead of the first digital signal $DS_1$~the (2N)th digital signal $DS_{2N}$, and the 2-to-1 multiplexer $2T1_{2N+1}$ is coupled to the next first data line L1', so that the (2N)th digital signal $DS_{2N}$ received by the 2-to-1 multiplexer $2T1_{2N+1}$ can be outputted to the next first data line L1' through the output multiplexer $MUX_{N+1}$. The external signal NC received by the 2-to-1 multiplexer $2T1_1$ is outputted to the first data line L1 of the ZigZag panel Z.

After comparing FIG. 4A with FIG. 4B, it can be found that the first analog signal $AS_1$~the (2N)th analog signal $AS_{2N}$ outputted by the driving apparatus 3 in FIG. 4A under the first operation mode are transmitted to the first data line L1~the (2N)th data line L2N of the ZigZag panel Z respectively; the first analog signal $AS_1$~the (2N)th analog signal $AS_{2N}$ outputted by the driving apparatus 3 in FIG. 4B under the second operation mode are transmitted to the second data line L2~the (2N)th data line L2N and the next first data line L1' of the ZigZag panel Z respectively.

Figure 4C:
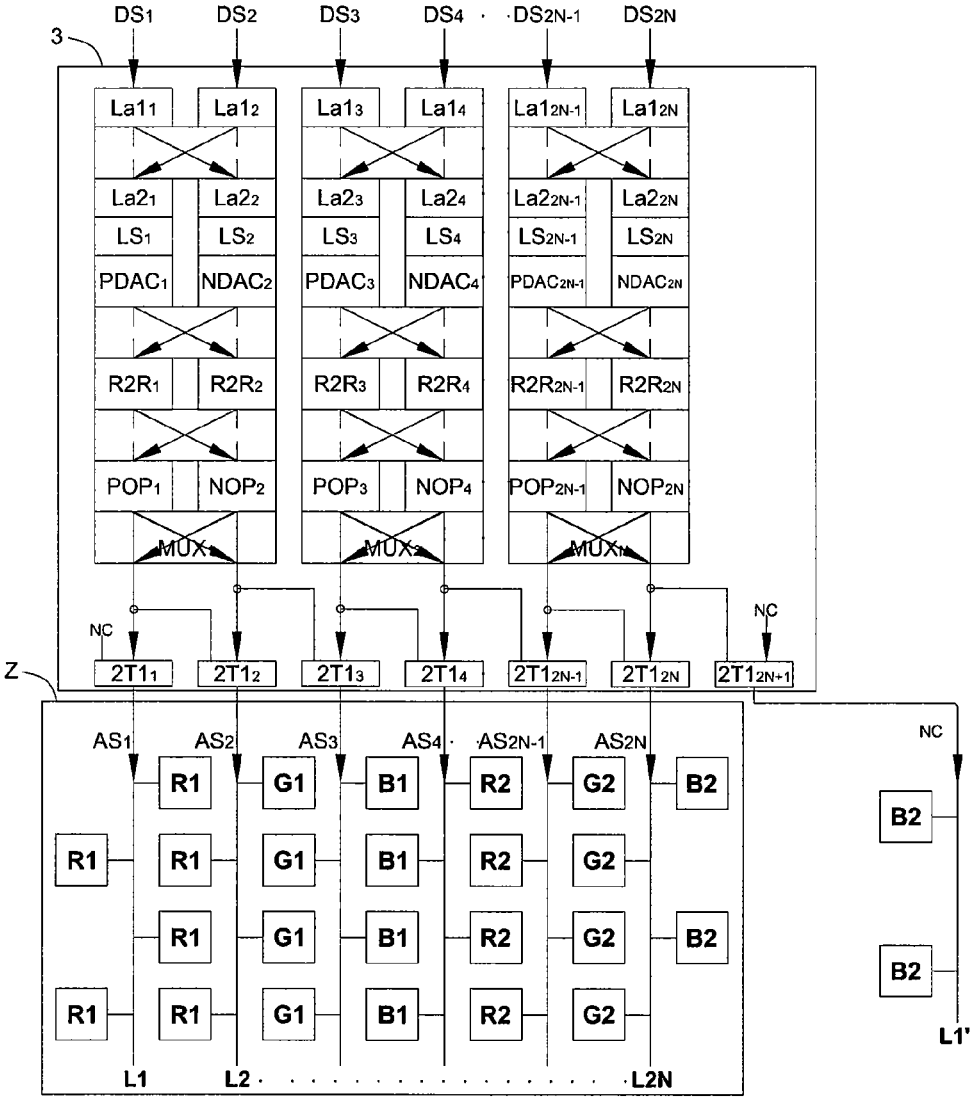

As shown in FIG. 4C, under the third operation mode of the driving apparatus 3, when the first latch module $La1_1$ of the channel $CH_1$ receives the first digital signal $DS_1$, the first latch module $La1_1$ transmits the first digital signal $DS_1$ to the second latch module $La2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module $R2R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the output multiplexer $MUX_1$, and then outputted to the first data line L1 of the ZigZag panel Z through the 2-to-1 multiplexers $2T1_2$.

When the first latch module $La1_2$ of the channel $CH_2$ receives the second digital signal $DS_2$, the first latch module $La1_2$ transmits the second digital signal $DS_2$ to the second latch module $La2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module $R2R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the output multiplexer $MUX_1$, and then outputted to the second data line L2 of the ZigZag panel Z through the 2-to-1 multiplexers $2T1_2$.

Similarly, when the first latch module $La1_3$ of the channel $CH_3$ receives the third digital signal $DS_3$, the first latch module $La1_3$ transmits the third digital signal $DS_3$ to the second latch module $La2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module $R2R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the output multiplexer $MUX_2$, and then outputted to the third data line L3 of the ZigZag panel Z through the 2-to-1 multiplexers $2T1_3$.

When the first latch module $La1_4$ of the channel $CH_4$ receives the fourth digital signal $DS_4$, the first latch module $La1_4$ transmits the fourth digital signal $DS_4$ to the second latch module $La2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module $R2R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the output multiplexer $MUX_2$, and then outputted to the fourth data line L4 of the ZigZag panel Z through the 2-to-1 multiplexers $2T1_4$, and so on.

It should be noted that the first digital signal $DS_1$~the (2N)th digital signal $DS_{2N}$ inputted into the channels $CH_1$~$CH_{2N}$ respectively are processed by the driving apparatus 3 and then outputted to the first data line L1~the (2N)th data line L2N of the ZigZag panel Z through the output multiplexers $MUX_1$~$MUX_N$ and 2-to-1 multiplexers $2T1_1$~$2T1_{2N}$ respectively. Therefore, the 2-to-1 multiplexer $2T1_{2N+1}$ receives the external signal NC instead of the first digital signal $DS_1$~the (2N)th digital signal $DS_{2N}$, and the 2-to-1 multiplexer $2T1_{2N+1}$ is coupled to the next first data line L1', so that the external signal NC received by the 2-to-1 multiplexer $2T1_{2N+1}$ can be outputted to the next first data line L1'.

Figure 4D:
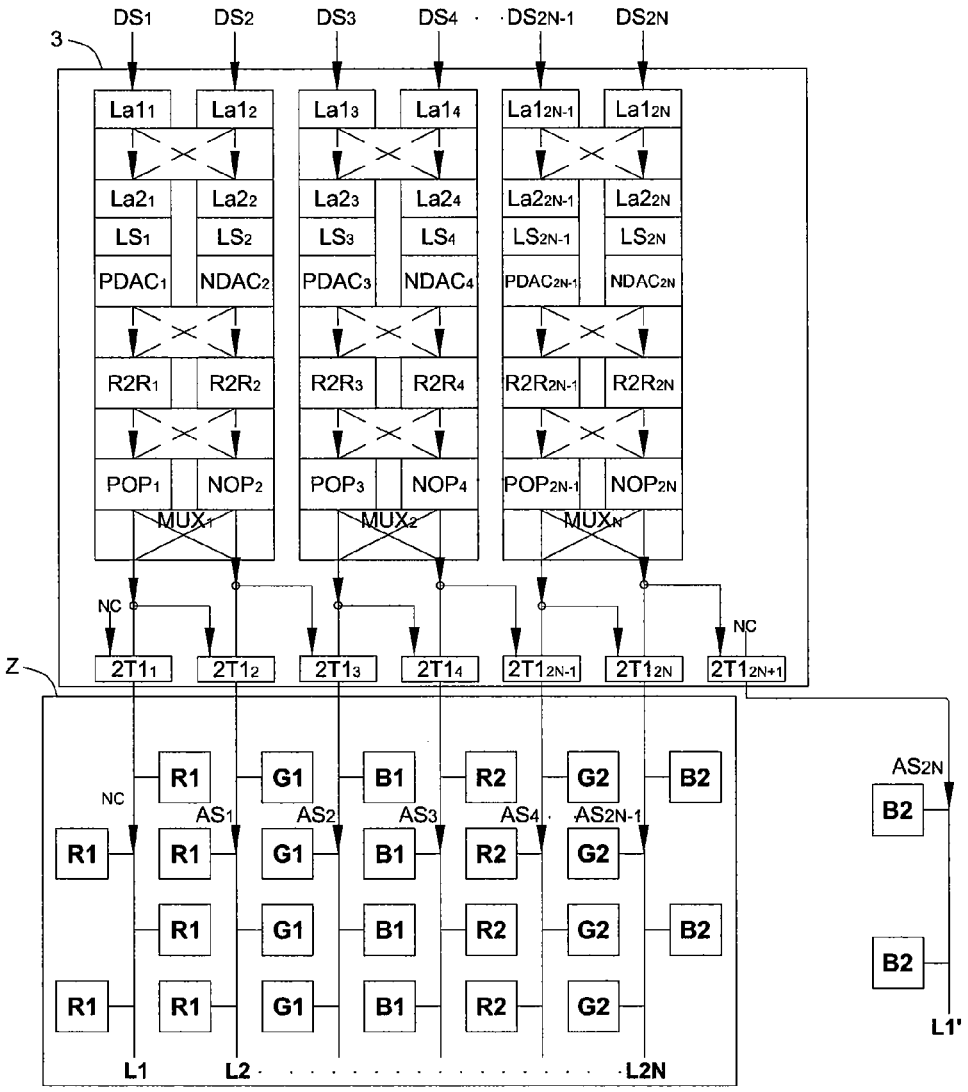

As shown in FIG. 4D, under the fourth operation mode of the driving apparatus 3, when the first latch module $La1_1$ of the channel $CH_1$ receives the first digital signal $DS_1$, the first latch module $La1_1$ transmits the first digital signal $DS_1$ to the second latch module $La2_1$ of the channel $CH_1$. Then, after the first digital signal $DS_1$ is processed by the level shift module $LS_1$, the P-type digital/analog conversion module $PDAC_1$, the resistor ladder conversion module $R2R_1$, and the P-type amplifying module $POP_1$ of the channel $CH_1$, the first digital signal $DS_1$ is converted into a first analog signal $AS_1$ and the first analog signal $AS_1$ is transmitted to the output multiplexer $MUX_1$, and then outputted to the second data line L2 of the ZigZag panel Z through the 2-to-1 multiplexers $2T1_2$.

When the first latch module $La1_2$ of the channel $CH_2$ receives the second digital signal $DS_2$, the first latch module $La1_2$ transmits the second digital signal $DS_2$ to the second latch module $La2_2$ of the channel $CH_2$. Then, after the second digital signal $DS_2$ is processed by the level shift module $LS_2$, the N-type digital/analog conversion module $NDAC_2$, the resistor ladder conversion module $R2R_2$, and the N-type amplifying module $NOP_2$ of the channel $CH_2$, the second digital signal $DS_2$ is converted into a second analog signal $AS_2$ and the second analog signal $AS_2$ is transmitted to the output multiplexer $MUX_1$, and then outputted to the third data line L3 of the ZigZag panel Z through the 2-to-1 multiplexers $2T1_3$.

Similarly, when the first latch module $La1_3$ of the channel $CH_3$ receives the third digital signal $DS_3$, the first latch module $La1_3$ transmits the third digital signal $DS_3$ to the second latch module $La2_3$ of the channel $CH_3$. Then, after the third digital signal $DS_3$ is processed by the level shift module $LS_3$, the P-type digital/analog conversion module $PDAC_3$, the resistor ladder conversion module $R2R_3$, and the P-type amplifying module $POP_3$ of the channel $CH_3$, the third digital signal $DS_3$ is converted into a third analog signal $AS_3$ and the third analog signal $AS_3$ is transmitted to the output multiplexer $MUX_2$, and then outputted to the fourth data line L4 of the ZigZag panel Z through the 2-to-1 multiplexers $2T1_4$. When the first latch module $La1_4$ of the channel $CH_4$ receives the fourth digital signal $DS_4$, the first latch module $La1_4$ transmits the fourth digital signal $DS_4$ to the second latch module $La2_4$ of the channel $CH_4$. Then, after the fourth digital signal $DS_4$ is processed by the level shift module $LS_4$, the N-type digital/analog conversion module $NDAC_4$, the resistor ladder conversion module $R2R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the output multiplexer $MUX_2$, and then outputted to the fifth data line L5 of the ZigZag panel Z through the 2-to-1 multiplexers $2T1_5$, and so on.

It should be noted that the first digital signal $DS_1$~the (2N)th digital signal $DS_{2N}$ inputted into the channels $CH_1$~$CH_{2N}$ respectively are processed by the driving apparatus 3 and then outputted to the first data line L1~the (2N)th data line L2N and the next first data line T1' of the ZigZag panel Z through the output multiplexers $MUX_1$~$MUX_N$ and the 2-to-1 multiplexers $2T1_{2N+1}$ respectively. Therefore, the 2-to-1 multiplexers $2T1_1$ receives the external signal NC instead of the first digital signal $DS_1$~the (2N)th digital signal $DS_{2N}$, and the 2-to-1 multiplexer $2T1_{2N+1}$ is coupled to the next first data line L1', so that the (2N)th analog signal $AS_{2N}$ received by the 2-to-1 multiplexer $2T1_{2N+1}$ can be outputted to the next first data line L1'. The external signal NC received by the 2-to-1 multiplexer $2T1_1$ is outputted to the first data line L1 of the ZigZag panel Z.

After comparing FIG. 4C with FIG. 4D, it can be found that the first analog signal $AS_1$~the (2N)th analog signal $AS_{2N}$ outputted by the driving apparatus 3 in FIG. 4C under the third operation mode are transmitted to the first data line L1~the (2N)th data line L2N of the ZigZag panel Z respectively; the first analog signal $AS_1$~the (2N)th analog signal $AS_{2N}$ outputted by the driving apparatus 3 in FIG. 4D under the fourth operation mode are transmitted to the second data line L2~the (2N)th data line L2N and the next first data line L1' of the ZigZag panel Z respectively.

Figure 5:
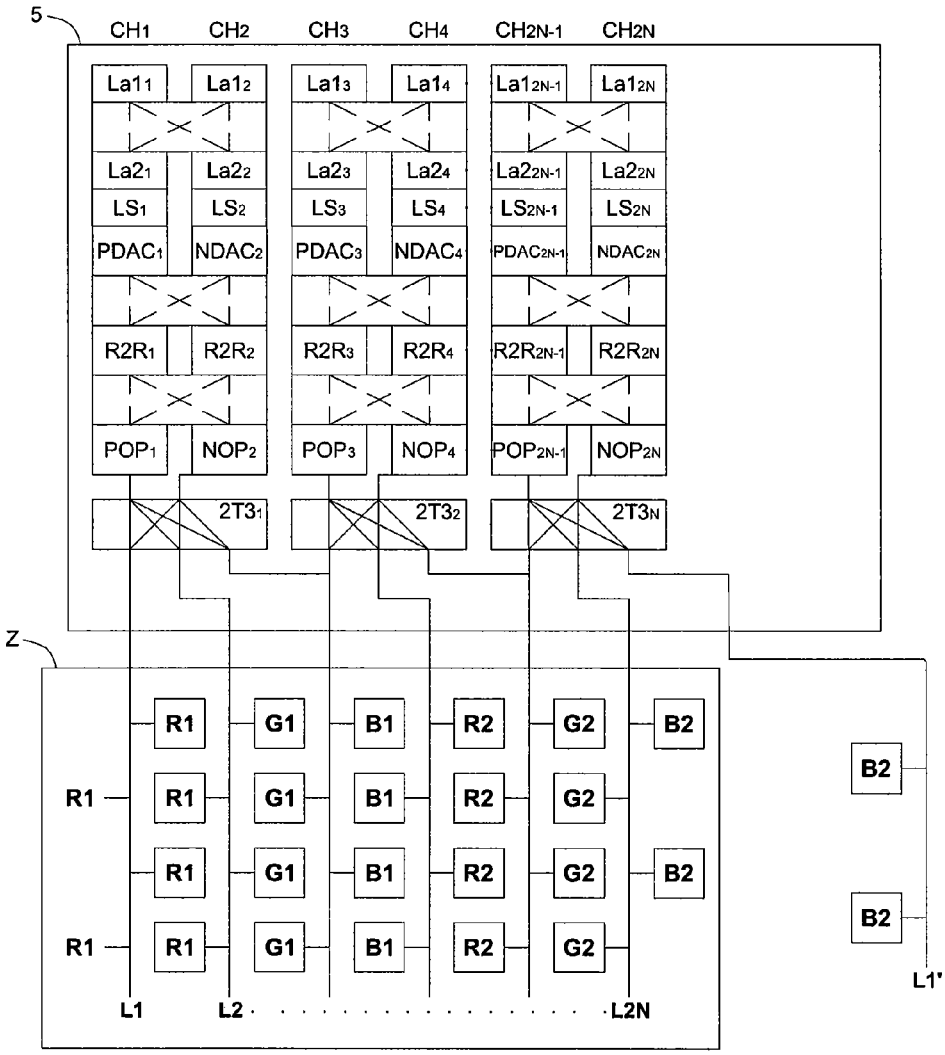
FIG. 5 illustrates a schematic diagram of the driving apparatus in the third embodiment of the invention.

A third embodiment of the invention is a driving apparatus. In this embodiment, the driving apparatus can be a source driver applied in a liquid crystal display, but not limited to this. The liquid crystal display can be a ZigZag panel. If the same column of sub-pixels of the Zigzag panel receives input voltages from the same channel of the driving apparatus at different times, the effect of cancelling offset can be achieved to improve the display quality of the liquid crystal display. Please refer to FIG. 5. FIG. 5 illustrates a schematic diagram of the driving apparatus in this embodiment. As shown in FIG. 5, the driving apparatus 5 includes 2N channels $CH_1$~$CH_{2N}$, and the 2N channels $CH_1$~$CH_{2N}$ can be divided into N channel groups: $CH_1$ and $CH_2$, $CH_3$ and $CH_4$, . . . , $CH_{2N-1}$ and $CH_{2N}$. Taking the first channel group $CH_1$ and $CH_2$ for example, the channel $CH_1$ includes a first latch module $La1_1$, a second latch module $La2_1$, a level shift module $LS_1$, a P-type digital/analog conversion module $PDAC_1$, a resistor ladder conversion module $R2R_1$, and a P-type amplifying module $POP_1$; the channel $CH_2$ includes a first latch module $La1_2$, a second latch module $La2_2$, a level shift module $LS_2$, a N-type digital/analog conversion module $NDAC_2$, a resistor ladder conversion module $R2R_2$, and a N-type amplifying module $NOP_2$.

Wherein, the first latch module $La1_1$ of the channel $CH_1$ is selectively coupled to the second latch module $La2_1$ of the channel $CH_1$ or the second latch module $La2_2$ of the channel $CH_2$; the first latch module $La1_2$ of the channel $CH_2$ is selectively coupled to the second latch module $La2_2$ of the channel $CH_2$ or the second latch module $La2_1$ of the channel $CH_1$; the level shift module $LS_1$ of the channel $CH_1$ is coupled between the second latch module $La2_1$ and the P-type digital/analog conversion module $PDAC_1$; the level shift module $LS_2$ of the channel $CH_2$ is coupled between the second latch module $La2_2$ and the N-type digital/analog conversion module $NDAC_2$; the P-type digital/analog conversion module $PDAC_1$ of the channel $CH_1$ is selectively coupled to the resistor ladder conversion module $R2R_1$ of the channel $CH_1$ or the resistor ladder conversion module $R2R_2$ of the channel $CH_2$; the N-type digital/analog conversion module $NDAC_2$ of the channel $CH_2$ is selectively coupled to the resistor ladder conversion module $R2R_2$ of the channel $CH_2$ or the resistor ladder conversion module $R2R_1$ of the channel $CH_1$; the resistor ladder conversion module $R2R_1$ of the channel $CH_1$ is selectively coupled to the P-type amplifying module $POP_1$ of the channel $CH_1$ or the N-type amplifying module $NOP_2$ of the channel $CH_2$; the resistor ladder conversion module $R2R_2$ of the channel $CH_2$ is selectively coupled to the N-type amplifying module $NOP_2$ of the channel $CH_2$ or the P-type amplifying module $POP_1$ of the channel $CH_1$.

It should be noted that in this embodiment, the driving apparatus 5 also includes N 2-to-3 multiplexers $2T3_1$~$2T3_N$. Each of the 2-to-3 multiplexers $2T3_1$~$2T3_N$ has two input terminals and three output terminals. Wherein, two input terminals of the 2-to-3 multiplexer $2T3_1$ are coupled to the P-type amplifying module $POP_1$ of the channel $CH_1$ and the N-type amplifying module $NOP_2$ of the channel $CH_2$, two input terminals of the 2-to-3 multiplexer $2T3_2$ are coupled to the P-type amplifying module $POP_3$ of the channel $CH_3$ and the N-type amplifying module $NOP_4$ of the channel $CH_4$, and so on. The three input terminals of the 2-to-3 multiplexer $2T3_1$ are coupled to the first data line L1~the third data line L3; the three input terminals of the 2-to-3 multiplexer $2T3_2$ are coupled to the third data line L3~the fifth data line L5, and so on.

Then, please refer to FIG. 6A through FIG. 6D. FIG. 6A, FIG. 6B, FIG. 6C, and FIG. 6D illustrate schematic diagrams of the signal transmission paths of the driving apparatus 5 in FIG. 5 under different operation modes respectively.

Figure 6A:
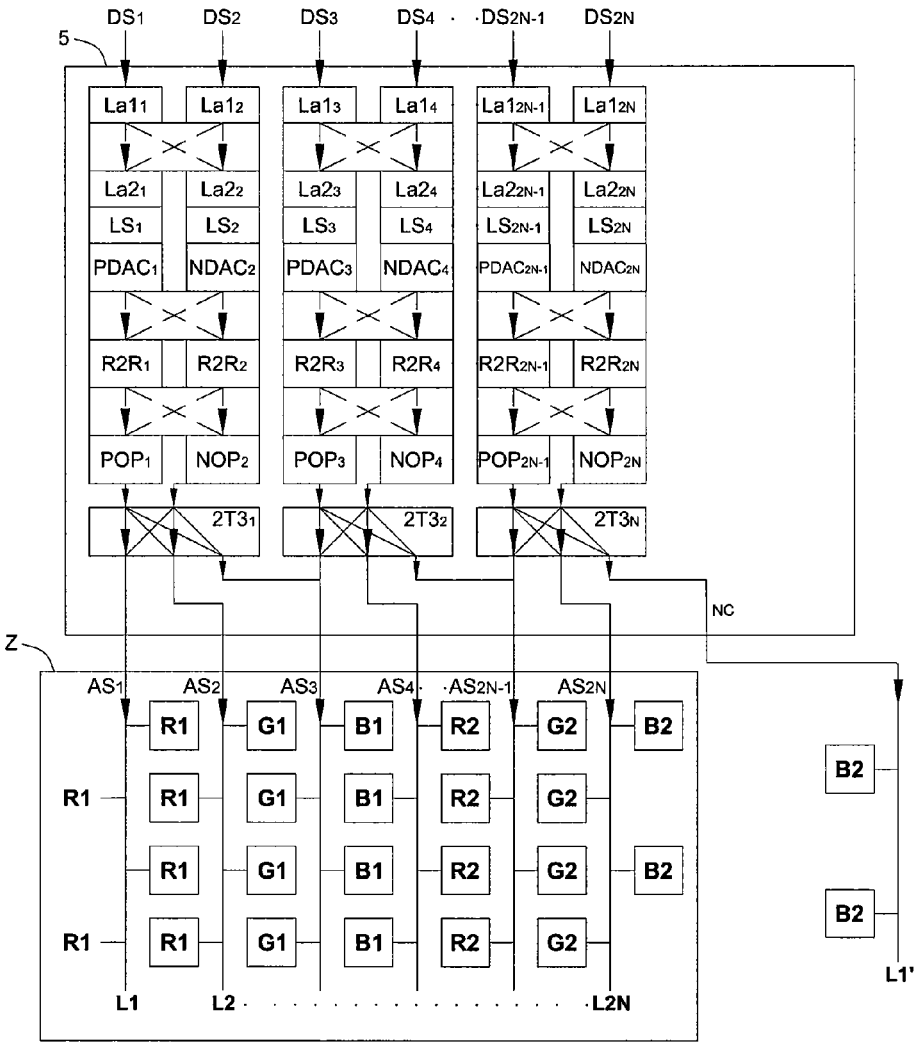
FIG. 6A, FIG. 6B, FIG. 6C, and FIG. 6D illustrate schematic diagrams of the signal transmission path of the driving apparatus 5 in FIG. 5 under different operation modes.

As shown in FIG. 6A, under the first operation mode of the driving apparatus 5, when the first latch module $La1_1$ of the channel $CH_1$ receives the first digital signal $DS_1$, the first latch module $La1_1$ transmits the first digital signal $DS_1$ to the second latch module $La2_1$ of the channel $CH_1$. Then, after the first digital signal $DS_1$ is processed by the level shift module $LS_1$, the P-type digital/analog conversion module $PDAC_1$, the resistor ladder conversion module $R2R_1$, and the P-type amplifying module $POP_1$ of the channel $CH_1$, the first digital signal $DS_1$ is converted into a first analog signal $AS_1$ and the first analog signal $AS_1$ is transmitted to the 2-to-3 multiplexer $2T3_1$, and then outputted to the first data line L1 of the ZigZag panel Z through the 2-to-3 multiplexer $2T3_1$.

When the first latch module $La1_2$ of the channel $CH_2$ receives the second digital signal $DS_2$, the first latch module $La1_2$ transmits the second digital signal $DS_2$ to the second latch module $La2_2$ of the channel $CH_2$. Then, after the second digital signal $DS_2$ is processed by the level shift module $LS_2$, the N-type digital/analog conversion module $NDAC_2$, the resistor ladder conversion module $R2R_2$, and the N-type amplifying module $NOP_2$ of the channel $CH_2$, the second digital signal $DS_2$ is converted into a second analog signal $AS_2$ and the second analog signal $AS_2$ is transmitted to the 2-to-3 multiplexer $2T3_1$, and then outputted to the second data line L2 of the ZigZag panel Z through the 2-to-3 multiplexer $2T3_1$.

Similarly, when the first latch module $La1_3$ of the channel $CH_3$ receives the third digital signal $DS_3$, the first latch module $La1_3$ transmits the third digital signal $DS_3$ to the second latch module $La2_3$ of the channel $CH_3$. Then, after the third digital signal $DS_3$ is processed by the level shift module $LS_3$, the P-type digital/analog conversion module $PDAC_3$, the resistor ladder conversion module $R2R_3$, and the P-type amplifying module $POP_3$ of the channel $CH_3$, the third digital signal $DS_3$ is converted into a third analog signal $AS_3$ and the third analog signal $AS_3$ is transmitted to the 2-to-3 multiplexer $2T3_2$, and then outputted to the third data line L3 of the ZigZag panel Z through the 2-to-3 multiplexer $2T3_2$. When the first latch module $La1_4$ of the channel $CH_4$ receives the fourth digital signal $DS_4$, the first latch module $La1_4$ transmits the fourth digital signal $DS_4$ to the second latch module $La2_4$ of the channel $CH_4$. Then, after the fourth digital signal $DS_4$ is processed by the level shift module $LS_4$, the N-type digital/analog conversion module $NDAC_4$, the resistor ladder conversion module $R2R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the 2-to-3 multiplexer $2T3_2$, and then outputted to the fourth data line L4 of the ZigZag panel Z through the 2-to-3 multiplexer $2T3_2$, and so on. By doing so, the first digital signal $DS_1$~the (2N)th digital signal $DS_{2N}$ inputted into the channels $CH_1$~$CH_{2N}$ respectively are processed by the driving apparatus 5 and then outputted to the first data line L1~the (2N)th data line L2N of the ZigZag panel Z through the 2-to-3 multiplexers $2T3_1$~$2T3_N$ respectively.

Figure 6B:
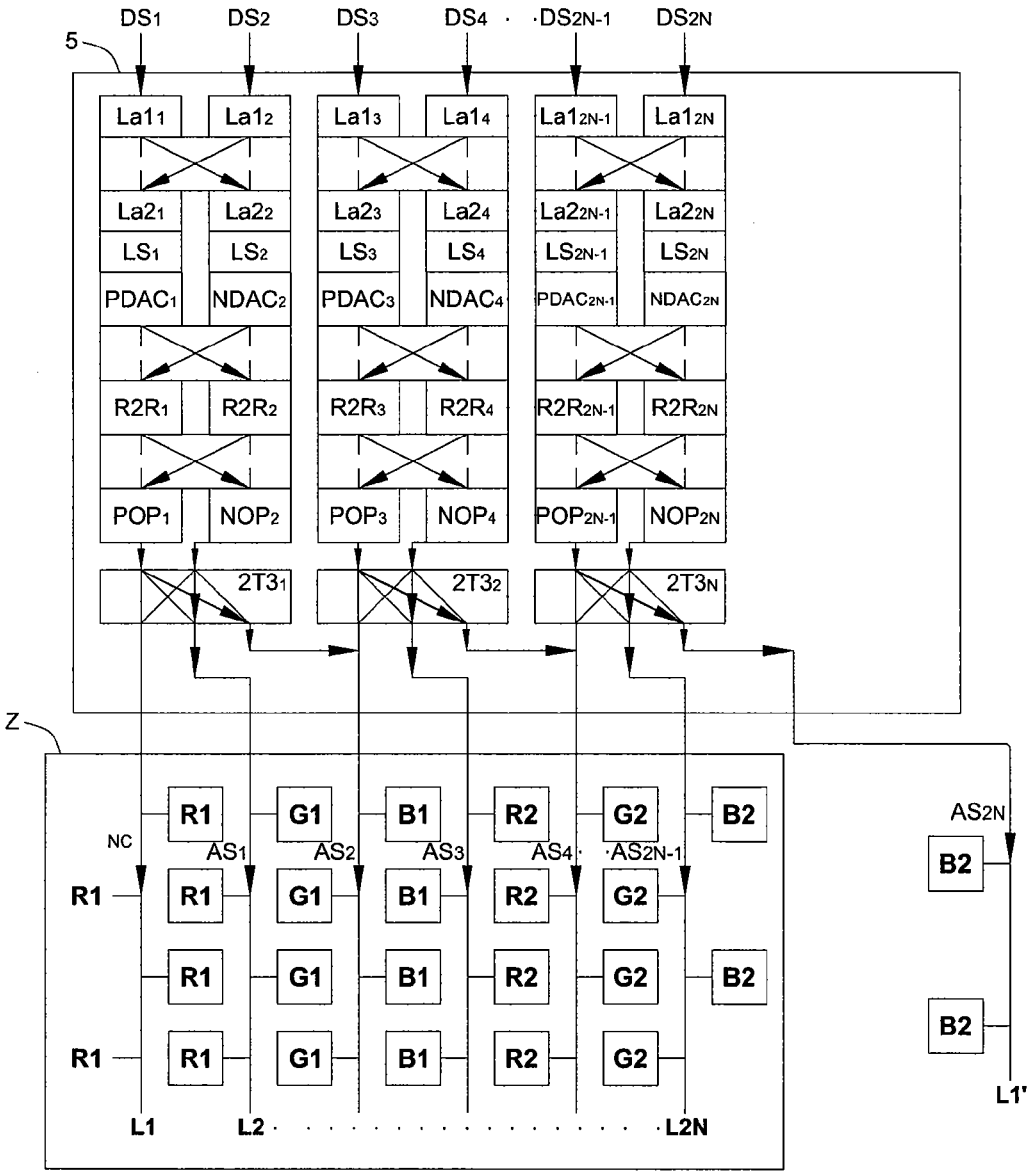

As shown in FIG. 6B, under the second operation mode of the driving apparatus 5, when the first latch module $La1_1$ of the channel $CH_1$ receives the first digital signal $DS_1$, the first latch module $La1_1$ transmits the first digital signal $DS_1$ to the second latch module $La2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module $R2R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the 2-to-3 multiplexer $2T3_1$, and then outputted to the second data line L2 of the ZigZag panel Z through the 2-to-3 multiplexer $2T3_1$.

When the first latch module $La1_2$ of the channel $CH_2$ receives the second digital signal $DS_2$, the first latch module $La1_2$ transmits the second digital signal $DS_2$ to the second latch module $La2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module $R2R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the 2-to-3 multiplexer $2T3_1$, and then outputted to the third data line L3 of the ZigZag panel Z through the 2-to-3 multiplexer $2T3_1$.

Similarly, when the first latch module $La1_3$ of the channel $CH_3$ receives the third digital signal $DS_3$, the first latch module $La1_3$ transmits the third digital signal $DS_3$ to the second latch module $La2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module $R2R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the 2-to-3 multiplexer $2T3_2$, and then outputted to the fourth data line L4 of the ZigZag panel Z through the 2-to-3 multiplexers $2T3_2$.

When the first latch module $La1_4$ of the channel $CH_4$ receives the fourth digital signal $DS_4$, the first latch module $La1_4$ transmits the fourth digital signal $DS_4$ to the second latch module $La2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module $R2R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the 2-to-3 multiplexer $2T3_2$, and then outputted to the fifth data line L5 of the ZigZag panel Z through the 2-to-3 multiplexer $2T3_2$, and so on.

It should be noted that the first digital signal $DS_1$~the (2N)th digital signal $DS_{2N}$ inputted into the channels $CH_1$~$CH_{2N}$ respectively are processed by the driving apparatus 5 and then outputted to the second data line L2~the (2N)th data line L2N and the next first data line L1' of the ZigZag panel Z through the 2-to-3 multiplexers $2T3_1$~$2T3_N$ respectively. Therefore, the 2-to-3 multiplexer $2T3_1$ has to transmit the external signal NC to the first data line L1 of the ZigZag panel Z. In addition, the 2-to-3 multiplexer $2T3_N$ is coupled to the next first data line L1', the (2N)th digital signal $DS_{2N}$ received by the 2-to-3 multiplexer $2T3_N$ is outputted to the next first data line L1' through the 2-to-3 multiplexer $2T3_N$.

After comparing FIG. 6A with FIG. 6B, it can be found that the first analog signal $AS_1$~the (2N)th analog signal $AS_{2N}$ outputted by the driving apparatus 5 in FIG. 6A under the first operation mode are transmitted to the first data line L1~the (2N)th data line L2N of the ZigZag panel Z respectively; the first analog signal $AS_1$~the (2N)th analog signal $AS_{2N}$ outputted by the driving apparatus 5 in FIG. 6B under the second operation mode are transmitted to the second data line L2~the (2N)th data line L2N and the next first data line L1' of the ZigZag panel Z respectively.

Figure 6C:
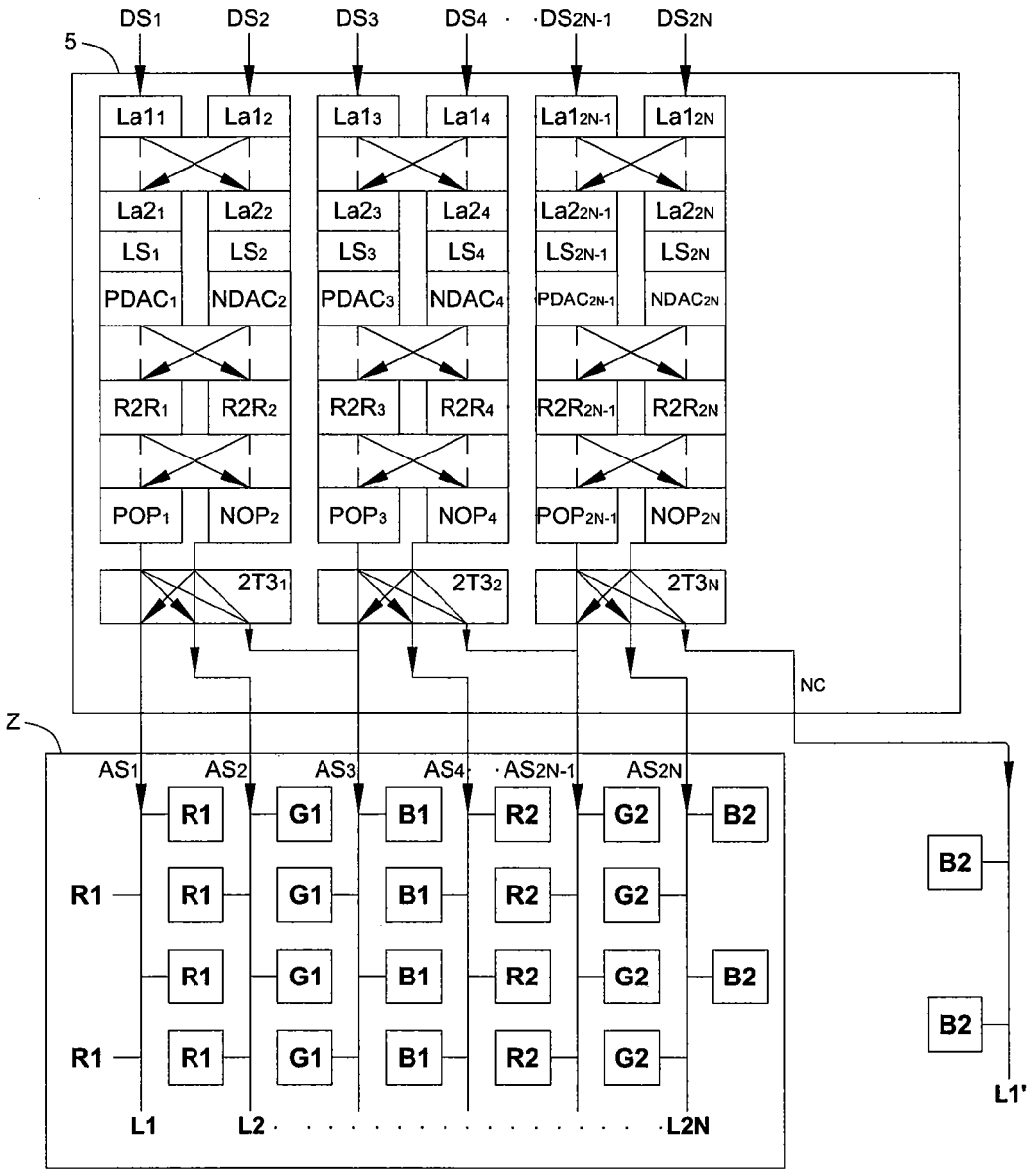

As shown in FIG. 6C, under the third operation mode of the driving apparatus 5, when the first latch module $La1_1$ of the channel $CH_1$ receives the first digital signal $DS_1$, the first latch module $La1_1$ transmits the first digital signal $DS_1$ to the second latch module $La2_2$ of the channel $CH_2$. Then, after the first digital signal $DS_1$ is processed by the level shift module $LS_2$ and the N-type digital/analog conversion module $NDAC_2$ of the channel $CH_2$, the resistor ladder conversion module $R2R_1$ of the channel $CH_1$, and the N-type amplifying module $NOP_2$ of the channel $CH_2$, the first digital signal $DS_1$ is converted into the first analog signal $AS_1$ and the first analog signal $AS_1$ is transmitted to the 2-to-3 multiplexer $2T3_1$, and then outputted to the first data line L1 of the ZigZag panel Z through the 2-to-3 multiplexer $2T3_1$.

When the first latch module $La1_2$ of the channel $CH_2$ receives the second digital signal $DS_2$, the first latch module $La1_2$ transmits the second digital signal $DS_2$ to the second latch module $La2_1$ of the channel $CH_1$. Then, after the second digital signal $DS_2$ is processed by the level shift module $LS_1$ and the P-type digital/analog conversion module $PDAC_1$ of the channel $CH_1$, the resistor ladder conversion module $R2R_2$ of the channel $CH_2$, and the P-type amplifying module $POP_1$ of the channel $CH_1$, the second digital signal $DS_2$ is converted into the second analog signal $AS_2$ and the second analog signal $AS_2$ is transmitted to the 2-to-3 multiplexer $2T3_1$, and then outputted to the second data line L2 of the ZigZag panel Z through the 2-to-3 multiplexer $2T3_1$.

Similarly, when the first latch module $La1_3$ of the channel $CH_3$ receives the third digital signal $DS_3$, the first latch module $La1_3$ transmits the third digital signal $DS_3$ to the second latch module $La2_4$ of the channel $CH_4$. Then, after the third digital signal $DS_3$ is processed by the level shift module $LS_4$ and the N-type digital/analog conversion module $NDAC_4$ of the channel $CH_4$, the resistor ladder conversion module $R2R_3$ of the channel $CH_3$, and the N-type amplifying module $NOP_4$ of the channel $CH_4$, the third digital signal $DS_3$ is converted into the third analog signal $AS_3$ and the third analog signal $AS_3$ is transmitted to the 2-to-3 multiplexer $2T3_2$, and then outputted to the third data line L3 of the ZigZag panel Z through the 2-to-3 multiplexers $2T3_2$.

When the first latch module $La1_4$ of the channel $CH_4$ receives the fourth digital signal $DS_4$, the first latch module $La1_4$ transmits the fourth digital signal $DS_4$ to the second latch module $La2_3$ of the channel $CH_3$. Then, after the fourth digital signal $DS_4$ is processed by the level shift module $LS_3$ and the P-type digital/analog conversion module $PDAC_3$ of the channel $CH_3$, the resistor ladder conversion module $R2R_4$ of the channel $CH_4$, and the P-type amplifying module $POP_3$ of the channel $CH_3$, the fourth digital signal $DS_4$ is converted into the fourth analog signal $AS_4$ and the fourth analog signal $AS_4$ is transmitted to the 2-to-3 multiplexer $2T3_2$, and then outputted to the fourth data line L4 of the ZigZag panel Z through the 2-to-3 multiplexer $2T3_2$, and so on. By doing so, the first digital signal $DS_1$~the (2N)th digital signal $DS_{2N}$ inputted into the channels $CH_1$~$CH_{2N}$ respectively are processed by the driving apparatus 5 and then outputted to the first data line L1~the (2N)th data line L2N of the ZigZag panel Z through the 2-to-3 multiplexers $2T3_1$~$2T3_N$ respectively.

Figure 6D:
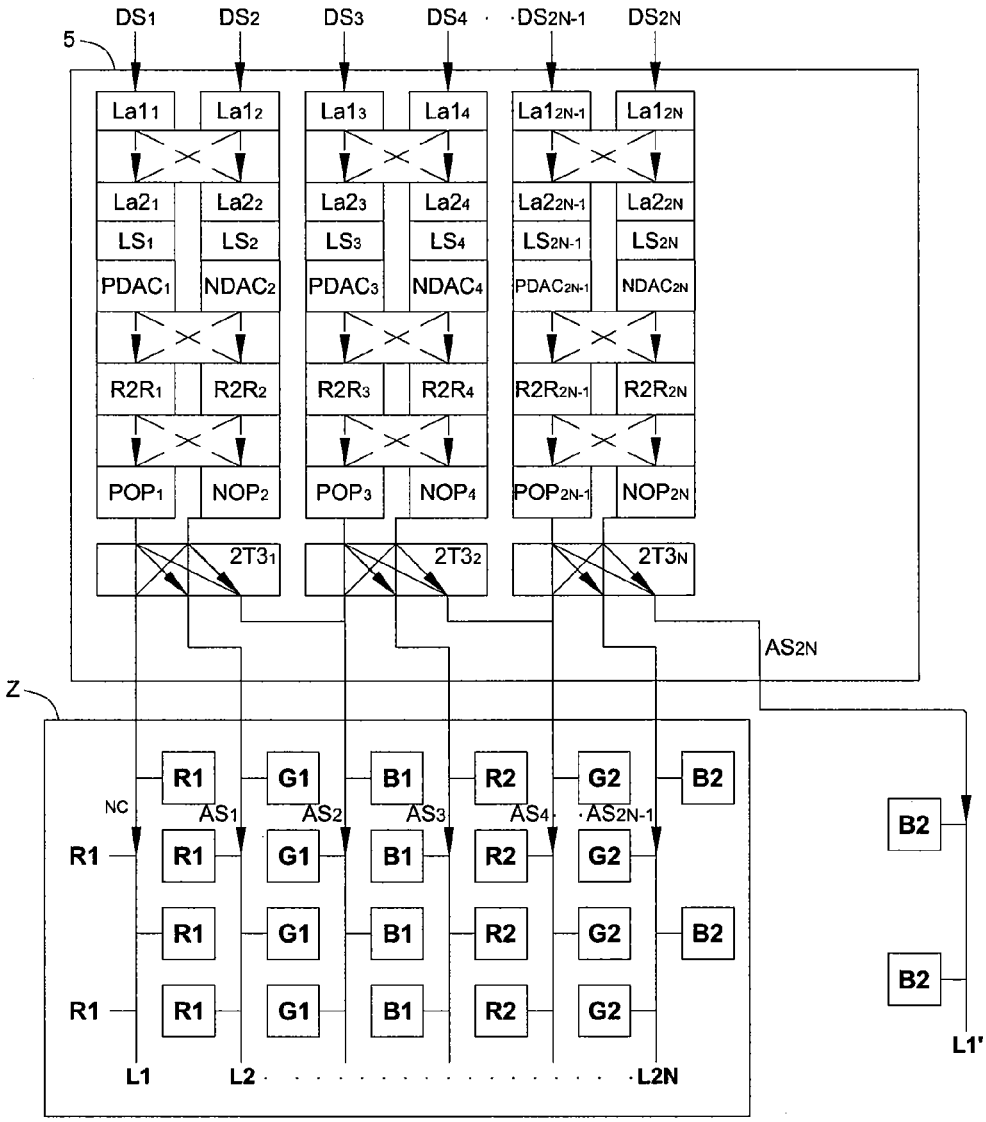

As shown in FIG. 6D, under the fourth operation mode of the driving apparatus 5, when the first latch module $La1_1$ of the channel $CH_1$ receives the first digital signal $DS_1$, the first latch module $La1_1$ transmits the first digital signal $DS_1$ to the second latch module $La2_1$ of the channel $CH_1$. Then, after the first digital signal $DS_1$ is processed by the level shift module $LS_1$, the P-type digital/analog conversion module $PDAC_1$, the resistor ladder conversion module $R2R_1$, and the P-type amplifying module $POP_1$ of the channel $CH_1$, the first digital signal $DS_1$ is converted into a first analog signal $AS_1$ and the first analog signal $AS_1$ is transmitted to the 2-to-3 multiplexer $2T3_1$, and then outputted to the second data line L2 of the ZigZag panel Z through the 2-to-3 multiplexer $2T3_1$.

When the first latch module $La1_2$ of the channel $CH_2$ receives the second digital signal $DS_2$, the first latch module $La1_2$ transmits the second digital signal $DS_2$ to the second latch module $La2_2$ of the channel $CH_2$. Then, after the second digital signal $DS_2$ is processed by the level shift module $LS_2$, the N-type digital/analog conversion module $NDAC_2$, the resistor ladder conversion module $R2R_2$, and the N-type amplifying module $NOP_2$ of the channel $CH_2$, the second digital signal $DS_2$ is converted into a second analog signal $AS_2$ and the second analog signal $AS_2$ is transmitted to the 2-to-3 multiplexer $2T3_1$, and then outputted to the third data line L3 of the ZigZag panel Z through the 2-to-3 multiplexer $2T3_1$.

Similarly, when the first latch module $La1_3$ of the channel $CH_3$ receives the third digital signal $DS_3$, the first latch module $La1_3$ transmits the third digital signal $DS_3$ to the second latch module $La2_3$ of the channel $CH_3$. Then, after the third digital signal $DS_3$ is processed by the level shift module $LS_3$, the P-type digital/analog conversion module $PDAC_3$, the resistor ladder conversion module $R2R_3$, and the P-type amplifying module $POP_3$ of the channel $CH_3$, the third digital signal $DS_3$ is converted into a third analog signal $AS_3$ and the third analog signal $AS_3$ is transmitted to the 2-to-3 multiplexer $2T3_2$, and then outputted to the fourth data line L4 of the ZigZag panel Z through the 2-to-3 multiplexer $2T3_2$. When the first latch module $La1_4$ of the channel $CH_4$ receives the fourth digital signal $DS_4$, the first latch module $La1_4$ transmits the fourth digital signal $DS_4$ to the second latch module $La2_4$ of the channel $CH_4$. Then, after the fourth digital signal $DS_4$ is processed by the level shift module $LS_4$, the N-type digital/analog conversion module $NDAC_4$, the resistor ladder conversion module $R2R_4$, and the N-type amplifying module $NOP_4$ of the channel $CH_4$, the fourth digital signal $DS_4$ is converted into a fourth analog signal $AS_4$ and the fourth analog signal $AS_4$ is transmitted to the 2-to-3 multiplexer $2T3_2$, and then outputted to the fifth data line L5 of the ZigZag panel Z through the 2-to-3 multiplexer $2T3_2$, and so on.

It should be noted that the first digital signal $DS_1$~the (2N)th digital signal $DS_{2N}$ inputted into the channels $CH_1$~$CH_{2N}$ respectively are processed by the driving apparatus 5 and then outputted to the first data line L2~the (2N)th data line L2N and the next first data line T1' of the ZigZag panel Z through the 2-to-3 multiplexers $2T3_1$~$2T3_N$ respectively. Therefore, the 2-to-3 multiplexer $2T3_1$ outputs the external signal NC to the next first data line T1', and the 2-to-3 multiplexer $2T3_N$ is coupled to the next first data line L1', so that the (2N)th analog signal $AS_{2N}$ received by the 2-to-3 multiplexer $2T3_N$ can be outputted to the next first data line L1'.

After comparing FIG. 6C with FIG. 6D, it can be found that the first analog signal $AS_1$~the (2N)th analog signal $AS_{2N}$ outputted by the driving apparatus 5 in FIG. 6C under the third operation mode are transmitted to the first data line L1~the (2N)th data line L2N of the ZigZag panel Z respectively; the first analog signal $AS_1$~the (2N)th analog signal $AS_{2N}$ outputted by the driving apparatus 5 in FIG. 6D under the fourth operation mode are transmitted to the second data line L2~the (2N)th data line L2N and the next first data line L1' of the ZigZag panel Z respectively.

Figure 7A:
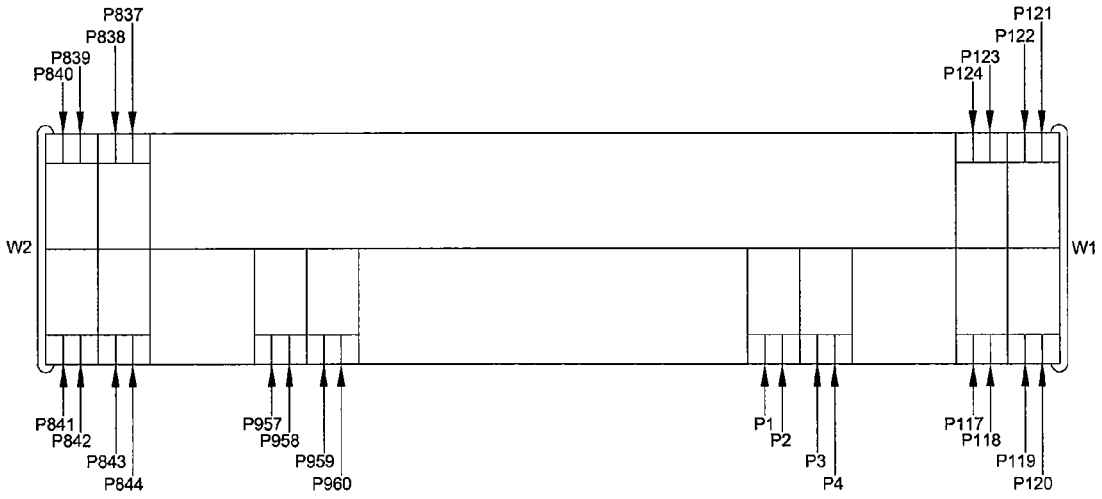
FIG. 7A and FIG. 7B illustrate schematic diagrams of two different types of circuit layout in the driving apparatus of the invention.
Figure 7B:
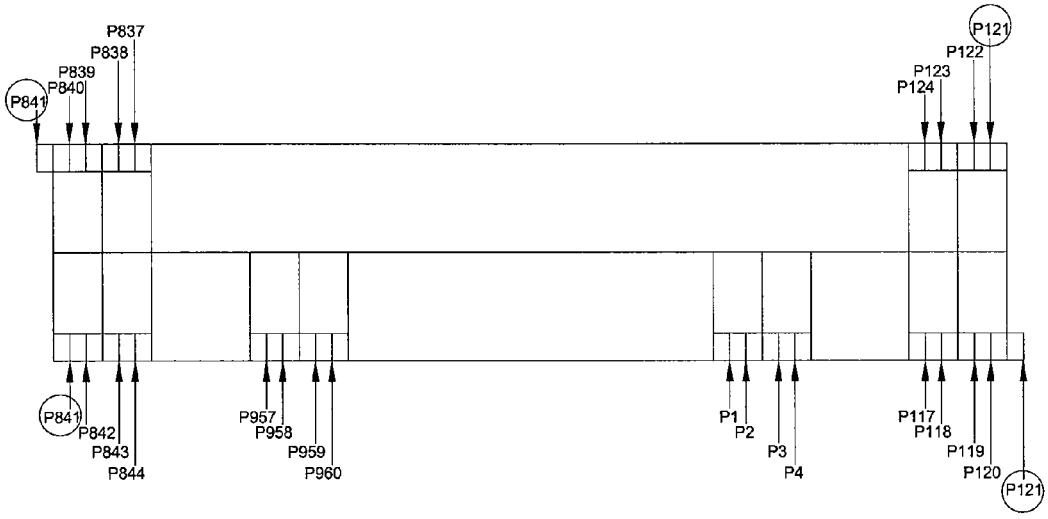

FIG. 7A and FIG. 7B illustrate schematic diagrams of two different types of circuit layout in the driving apparatus of the invention. It is assumed that the driving apparatus includes 960 channels. As shown in FIG. 7A, the pins P120 and P121 are disposed at two sides of the circuit board and they can be coupled by a wire W1; similarly, the pins P840 and P841 are disposed at two sides of the circuit board and they can be coupled by a wire W2. However, additional resistance will be generated, and the compensating resistor is necessary in the circuit to compensate. In order to reduce additional resistance generated by the coupling wires, as shown in FIG. 7B, a pin which is the same with the pin P121 is additionally disposed near the pin P120, and a pin which is the same with the pin P841 is additionally disposed near the pin P840, so that the compensating resistor is not necessary.

Compared to the prior art, the driving apparatus of the invention is applied in the liquid crystal display having a Zigzag panel and can meet the requirement of the Zigzag panel without adding two additional channels. In this invention, the same column of sub-pixels of the Zigzag panel will receives input voltages from the same channel of the driving apparatus at different times to achieve the effect of cancelling offset to improve the display quality of the liquid crystal display.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A driving apparatus, applied to a liquid crystal display, the driving apparatus comprising:

2N channels, divided into N channel groups, N being a positive integer, each channel group comprising a first channel and a second channel adjacent to the first channel, the first channel comprising at least one first latch module, a first level shift module, a P-type digital/analog conversion module, a first resistor ladder conversion module, and a P-type amplifying module, and the second channel comprising at least one second latch module, a second level shift module, a N-type digital/analog conversion module, a second resistor ladder conversion module, and a N-type amplifying module;

wherein the first level shift module of the first channel is coupled between the at least one first latch module and the P-type digital/analog conversion module, and the second level shift module of the second channel is coupled between the at least one second latch module and the N-type digital/analog conversion module; the P-type digital/analog conversion module of the first channel and the N-type digital/analog conversion module of the second channel are selectively coupled to the first resistor ladder conversion module of the first channel or the second resistor ladder conversion module of the second channel respectively; the P-type amplifying module and the N-type amplifying module are selectively coupled to the first resistor ladder conversion module of the first channel or the second resistor ladder conversion module of the second channel respectively;

wherein the at least one first latch module of the first channel receives a first digital signal and the first resistor ladder conversion module outputs a first analog signal corresponding to the first digital signal; the at least one second latch module of the second channel receives a second digital signal and the second resistor ladder conversion module outputs a second analog signal corresponding to the second digital signal.

2. The driving apparatus of claim 1, wherein the liquid crystal display comprises a ZigZag panel and the ZigZag panel comprises 2N data lines.

3. The driving apparatus of claim 2, further comprising (2N+2) 2-to-1 multiplexers and (N+1) output multiplexers, wherein the P-type amplifying module of the first channel is coupled to a first 2-to-1 multiplexer and a third 2-to-1 multiplexer of the (2N+2) 2-to-1 multiplexers respectively, and the N-type amplifying module of the second channel is coupled to a second 2-to-1 multiplexer and a fourth 2-to-1 multiplexer of the (2N+2) 2-to-1 multiplexers respectively, the first 2-to-1 multiplexer and the third 2-to-1 multiplexer are coupled to an external signal respectively, a first output multiplexer of the (N+1) output multiplexers is coupled to the first 2-to-1 multiplexer, the second 2-to-1 multiplexer, and a first data line and a second data line of the 2N data lines of the ZigZag panel, a second output multiplexer is coupled to the third 2-to-1 multiplexer, the fourth 2-to-1 multiplexer, and a third data line and a fourth data line of the 2N data lines of the ZigZag panel, a (N+1)th output multiplexer is coupled to a (2N−1)th 2-to-1 multiplexer, a (2N)th 2-to-1 multiplexer, and a next first data line.

4. The driving apparatus of claim 3, wherein under a first operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first output multiplexer is coupled between the first 2-to-1 multiplexer and the first data line and coupled between the second 2-to-1 multiplexer and the second data line, the first analog signal outputted by the first resistor ladder conversion module is amplified by the P-type amplifying module and then outputted to the first data line through the first 2-to-1 multiplexer and the first output multiplexer, the second analog signal outputted by the second resistor ladder conversion module is amplified by the N-type amplifying module and then outputted to the second data line through the second 2-to-1 multiplexer and the first output multiplexer, and the (N+1)th output multiplexer output the external signal received by the (2N−1)th 2-to-1 multiplexer to the next first data line; under a second operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first output multiplexer is coupled between the first 2-to-1 multiplexer and the first data line and coupled between the second 2-to-1 multiplexer and the second data line, the first analog signal outputted by the first resistor ladder conversion module is amplified by the N-type amplifying module and then outputted to the second data line through the second 2-to-1 multiplexer and the first output multiplexer, the second analog signal outputted by the second resistor ladder conversion module is amplified by the P-type amplifying module and then outputted to the third data line through the third 2-to-1 multiplexer and the second output multiplexer, the first output multiplexer outputs the external signal received by the first 2-to-1 multiplexer to the first data line, and the (N+1)th output multiplexer outputs the (2N)th analog signal received by the (2N−1)th 2-to-1 multiplexer to the next first data line; under a third operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first output multiplexer is coupled between the first 2-to-1 multiplexer and the second data line and coupled between the second 2-to-1 multiplexer and the first data line, the first analog signal outputted by the first resistor ladder conversion module is amplified by the N-type amplifying module and then outputted to the first data line through the second 2-to-1 multiplexer and the first output multiplexer, the second analog signal outputted by the second resistor ladder conversion module is amplified by the P-type amplifying module and then outputted to the second data line through the first 2-to-1 multiplexer and the first output multiplexer, and the (N+1) output multiplexer outputs the external signal received by the (2N+2)th 2-to-1 multiplexer to the next first data line; under a fourth operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first output multiplexer is coupled between the first 2-to-1 multiplexer and the second data line and coupled between the second 2-to-1 multiplexer and the first data line, the first analog signal outputted by the first resistor ladder conversion module is amplified by the P-type amplifying module and then outputted to the second data line through the first 2-to-1 multiplexer and the first output multiplexer, the second analog signal outputted by the second resistor ladder conversion module is amplified by the N-type amplifying module and then outputted to the third data line through the fourth 2-to-1 multiplexer and the second output multiplexer, the first output multiplexer outputs the external signal received by the second 2-to-1 multiplexer to the first data line and the (N+1)th output multiplexer output the (2N)th analog signal received by the (2N+2)th 2-to-1 multiplexer to the next first data line.

5. The driving apparatus of claim 2, further comprising N output multiplexers and (2N+1) 2-to-1 multiplexers, wherein the P-type amplifying module of the first channel and the N-type amplifying module of the second channel are both coupled to a first output multiplexer of the N output multiplexers, and a first 2-to-1 multiplexer of the (2N+1) 2-to-1 multiplexers is coupled to the first output multiplexer, the external signal, and the first data line, a second 2-to-1 multiplexer is coupled to the first output multiplexer and the second data line, a third 2-to-1 multiplexer is coupled to the first output multiplexer, the second output multiplexer, and the third data line, and the (2N+1) 2-to-1 multiplexer is coupled to the Nth output multiplexer and the next first data line.

6. The driving apparatus of claim 5, wherein under a first operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first output multiplexer is coupled between the P-type amplifying module and the first 2-to-1 multiplexer and coupled between the N-type amplifying module and the second 2-to-1 multiplexer, the first analog signal outputted by the first resistor ladder conversion module is amplified by the P-type amplifying module and then outputted to the first data line through the first output multiplexer and the first 2-to-1 multiplexer, the second analog signal outputted by the second resistor ladder conversion module is amplified by the N-type amplifying module and then outputted to the second data line through the first output multiplexer and the second 2-to-1 multiplexer, and the (2N+1)th 2-to-1 multiplexer receives the external signal and outputs the external signal to the next first data line; under a second operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first output multiplexer is coupled between the P-type amplifying module and the third 2-to-1 multiplexer and coupled between the N-type amplifying module and the second 2-to-1 multiplexer, the first analog signal outputted by the first resistor ladder conversion module is amplified by the N-type amplifying module and then outputted to the second data line through the first output multiplexer and the second 2-to-1 multiplexer, the second analog signal outputted by the second resistor ladder conversion module is amplified by the P-type amplifying module and then outputted to the third data line through the first output multiplexer and the third 2-to-1 multiplexer, the first 2-to-1 multiplexer receives the external signal and outputs the external signal to the first data line, and the (2N+1)th 2-to-1 multiplexer outputs the (2N)th analog signal received from the Nth output multiplexer to the next first data line; under a third operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first output multiplexer is coupled between the P-type amplifying module and the second 2-to-1 multiplexer and coupled between the N-type amplifying module and the first 2-to-1 multiplexer, the first analog signal outputted by the first resistor ladder conversion module is amplified by the N-type amplifying module and then outputted to the first data line through the first output multiplexer and the first 2-to-1 multiplexer, the second analog signal outputted by the second resistor ladder conversion module is amplified by the P-type amplifying module and then outputted to the second data line through the first output multiplexer and the second 2-to-1 multiplexer, and the (2N+1)th 2-to-1 multiplexer receives the external signal and outputs the external signal to the next first data line; under a fourth operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first output multiplexer is coupled between the P-type amplifying module and the second 2-to-1 multiplexer and coupled between the N-type amplifying module and the third 2-to-1 multiplexer, the first analog signal outputted by the first resistor ladder conversion module is amplified by the P-type amplifying module and then outputted to the second data line through the first output multiplexer and the second 2-to-1 multiplexer, the second analog signal outputted by the second resistor ladder conversion module is amplified by the N-type amplifying module and then outputted to the third data line through the first output multiplexer and the third 2-to-1 multiplexer, the first 2-to-1 multiplexer receives the external signal and outputs the external signal to the first data line and the (2N+1)th 2-to-1 multiplexer outputs the (2N)th analog signal received from the Nth output multiplexer to the next first data line.

7. The driving apparatus of claim 2, further comprising N 2-to-3 multiplexers, wherein the P-type amplifying module of the first channel and the N-type amplifying module of the second channel are both coupled to a first 2-to-3 multiplexer of the N 2-to-3 multiplexers, and the first 2-to-3 multiplexer is coupled to the first data line, the second data line, and the third data line, a second 2-to-3 multiplexer is coupled to the third data line, the fourth data line, and fifth data line, the Nth 2-to-3 multiplexer is coupled to the (2N−1)th data line, the (2N)th data line, and the next first data line.

8. The driving apparatus of claim 7, wherein under a first operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first 2-to-3 multiplexer is coupled between the P-type amplifying module and the first data line and coupled between the N-type amplifying module and the second data line, the first analog signal outputted by the first resistor ladder conversion module is amplified by the P-type amplifying module and then outputted to the first data line through the first 2-to-3 multiplexer, the second analog signal outputted by the second resistor ladder conversion module is amplified by the N-type amplifying module and then outputted to the second data line through the first 2-to-3 multiplexer; under a second operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first 2-to-3 multiplexer is coupled between the P-type amplifying module and the third data line and coupled between the N-type amplifying module and the second data line, the first analog signal outputted by the first resistor ladder conversion module is amplified by the N-type amplifying module and then outputted to the second data line through the first 2-to-3 multiplexer, the second analog signal outputted by the second resistor ladder conversion module is amplified by the P-type amplifying module and then outputted to the third data line through the first 2-to-3 multiplexer, the first 2-to-3 multiplexer outputs the external signal to the first data line, and the Nth 2-to-3 multiplexer outputs the (2N)th analog signal to the next first data line; under a third operation mode, the first resistor ladder conversion module of the first channel is coupled between the N-type digital/analog conversion module and the N-type amplifying module of the second channel, the second resistor ladder conversion module of the second channel is coupled between the P-type digital/analog conversion module and the P-type amplifying module of the first channel, the first 2-to-3 multiplexer is coupled between the P-type amplifying module and the second data line and coupled between the N-type amplifying module and the first data line, the first analog signal outputted by the first resistor ladder conversion module is amplified by the N-type amplifying module and then outputted to the first data line through the first 2-to-3 multiplexer, the second analog signal outputted by the second resistor ladder conversion module is amplified by the P-type amplifying module and then outputted to the second data line through the first 2-to-3 multiplexer, and the Nth 2-to-3 multiplexer outputs the external signal to the next first data line; under a fourth operation mode, the first resistor ladder conversion module of the first channel is coupled between the P-type digital/analog conversion module and the P-type amplifying module of the first channel, the second resistor ladder conversion module of the second channel is coupled between the N-type digital/analog conversion module and the N-type amplifying module of the second channel, the first 2-to-3 multiplexer is coupled between the P-type amplifying module and the second data line and coupled between the N-type amplifying module and the third data line, the first analog signal outputted by the first resistor ladder conversion module is amplified by the P-type amplifying module and then outputted to the second data line through the first 2-to-3 multiplexer, the second analog signal outputted by the second resistor ladder conversion module is amplified by the N-type amplifying module and then outputted to the third data line through the first 2-to-3 multiplexer, the first 2-to-3 multiplexer outputs the external signal to the first data line and the Nth 2-to-3 multiplexer outputs the (2N)th analog signal to the next first data line.

* * * * *